US007695762B2

(12) United States Patent
Sekiya et al.

(10) Patent No.: US 7,695,762 B2
(45) Date of Patent: Apr. 13, 2010

(54) THERMAL TRANSFER IMAGE RECEIVING SHEET AND PRODUCTION METHOD OF THE SAME

(75) Inventors: Tadanobu Sekiya, Hachioji (JP); Kenji Michiue, Hachioji (JP); Hiroki Nakane, Hino (JP)

(73) Assignee: Dai Nippon Printing Co., Ltd., Shinjuku-Ku (JP)

( * ) Notice: Subject to any disclaimer, the term of this patent is extended or adjusted under 35 U.S.C. 154(b) by 917 days.

(21) Appl. No.: 11/132,045

(22) Filed: May 18, 2005

(65) Prior Publication Data

US 2005/0266185 A1 Dec. 1, 2005

(30) Foreign Application Priority Data

May 25, 2004 (JP) ..... 2004-154446

(51) Int. Cl.
*B41M 5/035* (2006.01)
*B41M 5/50* (2006.01)
*B41M 3/12* (2006.01)

(52) U.S. Cl. ..... 427/152; 503/227

(58) Field of Classification Search ..... None
See application file for complete search history.

(56) References Cited

U.S. PATENT DOCUMENTS 5,562,975 A 10/1996 Sugai et al.
5,902,770 A * 5/1999 Narita et al. ..... 503/227
6,696,390 B1 * 2/2004 Hatada et al. ..... 503/227

FOREIGN PATENT DOCUMENTS

| | | | |
|---|---|---|---|
| JP | 06-171240 | * | 6/1994 |
| JP | 06-247061 | A1 | 9/1994 |
| JP | 07-179028 | A1 | 7/1995 |
| JP | 08-025819 | A1 | 1/1996 |
| JP | 10-067181 | * | 3/1998 |
| JP | 10-293378 | A1 | 11/1998 |
| JP | 10-297081 | A1 | 11/1998 |
| JP | 11-212212 | A1 | 8/1999 |
| JP | 11-227345 | A1 | 8/1999 |
| JP | 11-277917 | A1 | 10/1999 |
| JP | 2000-002964 | A1 | 1/2000 |
| JP | 2000-153214 | A1 | 6/2000 |
| JP | 2002-153797 | A1 | 5/2002 |
| JP | 2002-192842 | A1 | 7/2002 |

* cited by examiner

*Primary Examiner*—Bruce H Hess
(74) *Attorney, Agent, or Firm*—Burr & Brown

(57) ABSTRACT

A thermal transfer image receiving sheet containing a substrate having thereon a thermal insulation layer, an intermediate layer and an image receiving layer in that order, wherein the thermal insulation layer, the image receiving layer and the intermediate layer each is formed by an aqueous coating method.

8 Claims, No Drawings

THERMAL TRANSFER IMAGE RECEIVING SHEET AND PRODUCTION METHOD OF THE SAME

This application is based on Japanese Patent Application No. 2004-154446 filed on May 25, 2004, in Japanese Patent Office, the entire content of which is hereby incorporated by reference.

FIELD OF THE INVENTION

The present invention relates to a thermal transfer image receiving sheet having a porous intermediate layer, which is used by overlapping with a thermal transfer ink sheet, and to a production method of the thermal transfer image receiving sheet.

BACKGROUND

A technique, so called as a dye thermal transfer method, is known, in which an ink sheet containing a thermal diffusive colorant capable of thermally transferring by diffusion is faced to an image receiving layer of a thermal transfer image receiving sheet and the thermally diffusive colorant is image-wise transferred by a thermal printing means such as a thermal head or a laser to form an image. The thermal transfer method has been acknowledged as a method which enables forming an image using digital data without using any treatment liquid such as a developer, and forming an image having high quality comparable to that of a silver salt photograph.

It has been recognized that it is important to give a thermal insulation function and a cushion function to the thermal image receiving sheet for obtaining a high quality image forming property in the recording system using the dye thermal transfer method.

For such problems, known is a method in which a foamed film having a function of thermal insulation and a function of cushion is pasted on a substrate and an image receiving layer is provided on the foamed film. In this method, however, the foamed film shrinks by heat generated when the image receiving layer is applied on the foamed film, resulting in curling of the produced sheet. In order to overcome the problem, various methods have been tested, for example: (i) using a novel functional layer having a thermal insulation function and a cushioning function; (ii) using a thermal transfer image receiving sheet produced by a process including no pasting step of the foamed film to minimize the curl caused by the heat generated in the production process; and (iii) using a variety of coating method.

For example, disclosed is a production method of a thermal transfer image receiving sheet in which an aqueous intermediate layer containing hollow particles and an aqueous image receiving layer containing a release agent are formed by a wet-on-wet coating method. Thus prepared thermal transfer image receiving sheet exhibits: (i) a sufficient adhesion of the image receiving layer and the intermediate layer; (ii) a satisfactory anti-blocking property against an ink-donor sheet; and (iii) a high drying energy efficiency in the production process (for example, see Patent Document 1).

However, in a replication test of Patent Document 1, the following features were observed:

(i) In a currently conducted high rate printing, the printing sensitivity is not fully enough. This is supposed to be because the colorant transferred from the thermal transfer ink sheet tends to have a hydrophobic nature, resulting in a relatively poor dyeing property of an image receiving layer containing a hydrophilic binder. Accordingly, a high flatness of the image receiving layer surface is required and a high coating accuracy become important. However, in the disclosed technique of Patent Document 1, the flatness is not fully sufficient and white spots in the image tends to occur. In a process of coating an intermediate layer containing low specific gravity particles, for example, hollow particles, followed by coating an image receiving layer on the intermediate layer, the image receiving layer is coated while the previously coated intermediate layer is still wet, as disclosed in the above documents. Therefore, the hollow particles often float on the surface of the intermediate layer, and the surface flatness tends to be lost. In a structure of an image receiving layer in which the intermediate layer is adjacent to the image receiving layer, the unevenness of the intermediate layer surface directly affects the flatness of the image receiving layer resulting in a tendency to give rise to white spots in the image;

(ii) The robustness of the adhesion between the intermediate layer and the image receiving layer is said to be one of the effects of the invention disclosed in Patent Document 1, however, it may have the following problem. Namely, in a high rate printing apparatus, in order to attain short time dyeing and the following short time release of layers, the amount of the release agent added to the image receiving layer is required to be increased. However, the increased amount of release agent may lower the adhesion between the intermediate layer and the image receiving layer;

(iii) Durability of an image may also be a problem. According to the current tendency to increase printing sensitivity, the molecular weight of a dye is becoming smaller, and the technique to prevent migration of dye at a higher temperature or under higher humidity is becoming important. However, in Patent Document 1, the provision to the above problem is not fully considered and lowering of hue density of an image or bleeding of the image tends to be observed at a higher temperature or under higher humidity, after formation of an image;

(iv) A wet-on-wet coating method may provide a higher drying energy efficiency, however, the number of coating steps are not reduced and the productivity of a thermal transfer image receiving sheet is not fully increased.

Patent Document 1: Japanese Patent Publication Open to Public Inspection (hereafter referred to as JP-A) No. 6-171240

SUMMARY OF THE INVENTION

An object of the present invention is to provide a thermal transfer image receiving sheet exhibiting sufficient adhesion between constituting layers, a high printing sensitivity, formation of a homogeneous image without giving rise to white spots, and durability of the image and a production method of the thermal transfer image receiving sheet, as well as to provide a production method of the thermal transfer image receiving sheet, in which curl of the sheet due to the generated heat in the production process is suppressed and a high productivity of the thermal transfer image receiving sheet is attained.

One of the features of the invention is a thermal transfer image receiving sheet containing a substrate having thereon a thermal insulation layer, an intermediate layer and an image receiving layer in that order, wherein the thermal insulation layer, the image receiving layer and the intermediate layer each is formed by an aqueous coating method.

DESCRIPTION OF THE PREFERRED EMBODIMENTS

The above object of the invention is achieved by the following structures.

(1) A thermal transfer image receiving sheet containing a substrate having thereon a thermal insulation layer, an intermediate layer and an image receiving layer in that order, wherein the thermal insulation layer, the image receiving layer and the intermediate layer each is formed by an aqueous coating method.

(2) The thermal transfer image receiving sheet of Item (1) further comprising an additional layer, wherein the additional layer is formed by the aqueous coating method.

(3) The thermal transfer image receiving sheet of Item (1) or Item (2), wherein a pair of adjacent layers are formed by a simultaneous multilayer coating method.

(4) The thermal transfer image receiving sheet of any one of Items (1) to (3), wherein all layers provided on an surface of the substrate having the image receiving layer are formed by a simultaneous multilayer coating method.

(5) The thermal transfer image receiving sheet of any one of Items (1) to (4), wherein the image receiving layer contains a compound having a metal ion; and the compound having the metal ion forms a chelate compound by reacting with a colorant capable of forming a chelate.

(6) The thermal transfer image receiving sheet of any one of Items (1) to (5), wherein the image receiving layer contains a release agent.

(7) The thermal transfer image receiving sheet of any one of Items (1) to (4), wherein the image receiving layer is comprised of two or more sublayers; an image receiving sublayer farthest from the substrate contains a release agent; an image receiving sublayer except for the image receiving sublayer farthest from the substrate contains a compound having a metal ion; and the compound having the metal ion forms a chelate compound by reacting with a colorant capable of forming a chelate.

(8) The thermal transfer image receiving sheet of any one of Items (1) to (7), wherein the substrate is a resin coated paper sheet having a thickness of 50 to 250 μm.

(9) A method for producing a thermal transfer image receiving sheet containing the steps of: (i) providing a thermal insulation layer on a substrate by an aqueous coating method; (ii) providing an intermediate layer on the thermal insulation layer by the aqueous coating method; (iii) providing an image receiving layer on the intermediate layer by the aqueous coating method; and (iv) drying the coated thermal insulation layer, the coated intermediate layer and the coated image receiving layer.

(10) The method for producing a thermal transfer image receiving sheet of Item (9) further comprising a step of providing an additional layer by the aqueous coating method prior to the step (iv).

(11) The method for producing the thermal transfer image receiving sheet of Item (8) or Item (9), wherein a pair of adjacent layers are formed by a simultaneous multilayer coating method.

(12) The method for producing the thermal transfer image receiving sheet of any one of Items (9) to (11), wherein all layers provided on an surface of the substrate having the image receiving layer are formed by a simultaneous multilayer coating method.

(13) The method for producing the thermal transfer image receiving sheet of any one of Items (9) to (12) further containing a step of setting by cooling the coated thermal insulation layer, the coated intermediate layer and the coated image receiving layer between the step of providing the image receiving layer and the step of drying the coated layers.

(14) The method for producing the thermal transfer image receiving sheet of any one of Items (9) to (13) further containing a step of aging the coated thermal insulation layer, the coated intermediate layer and the coated image receiving layer after the step of drying the coated layers.

(15) The method for producing the thermal transfer image receiving sheet of any one of Items (9) to (14) containing a step of simultaneously coating two or more layers, wherein the following relationship is satisfied:

$$\eta_2 > \eta_1$$

wherein $\eta_1$ represents a viscosity of a coating liquid of an undermost layer and $\eta_2$ represents a viscosity of a coating liquid of any one of other layers.

(16) The method for producing the thermal transfer image receiving sheet of any one of Items (9) to (15) containing a step of simultaneously coating two or more layers, wherein Formulas (1) and (2) are satisfied in every adjacent pair of layers:

$$Ts(L) \geqq Ts(U) \quad \text{Formula (1)}$$

$$Td(L) \geqq Td(U) \quad \text{Formula (2)}$$

wherein:

Ts(L) represents a static surface tension of a coating liquid of a lower layer of the adjacent pair of layers;

Ts(U) represents a static surface tension of a coating liquid of an upper layer of the adjacent pair of layers;

Td(L) represents a dynamic surface tension of the coating liquid of the lower layer of the adjacent pair of layers; and Td(U) represents a dynamic surface tension of the coating liquid of the upper layer of the adjacent pair of layers.

The invention will now be detailed.

A thermal transfer image receiving sheet of the present invention containing a substrate having thereon a thermal insulation layer, an intermediate layer and an image receiving layer in that order, wherein the thermal insulation layer, the image receiving layer and the intermediate layer each is formed by an aqueous coating method, was found to provide a thermal transfer image receiving sheet exhibiting sufficient adhesion between constituting layers, a high printing sensitivity, formation of a homogeneous image without giving rise to white spots, and durability of the image, as well as to show minimized formation of curl of the sheet due to the generated heat in the production process and a high productivity of the thermal transfer image receiving sheet. The thermal transfer image receiving sheet of the present invention may further have an additional layer which is also formed by an aqueous coating method. The role or the function of the additional layer is not specifically limited.

<<Thermal Transfer Image Receiving Sheet>>

The thermal transfer image receiving sheet of the present invention (hereafter referred to as the image receiving sheet) is described in detail below.

The image receiving sheet of the invention has at least a porous intermediate layer and a image receiving layer on a substrate.

(Substrate)

The substrate to be employed in the image receiving sheet has a role of holding the image receiving layer and preferably has mechanical strength sufficient for handling even under an excessively heated condition, since heat is applied in the thermal transfer process.

Examples of the material for such a substrate include: cellulose fiber paper, for example, condenser paper, glassine paper, sulfate paper, paper having highly sized degree, synthesized paper (polyolefin type and polystyrene type), high quality paper, art paper, coated paper, cast coated paper, wall paper, backing paper, paper impregnated with synthesized resin or emulsion, synthesized rubber latex impregnated paper, synthesized resin added paper, and board paper; and films of polymer, for example, polyester, polyacrylate, polycarbonate, polyurethane, polyimide, polyetherimide, a cellulose derivative, polyethylene, ethylene-vinyl acetate copolymer, polypropylene, polystyrene, acryl, polyvinyl chloride, polyvinylidene chloride, polyvinyl alcohol, polyvinyl butyral, nylon, polyether ether ketone, polysulfone, polyether sulfone, tetrafluoroethylene, perfluoroalkylvinyl vinyl ether, polyvinyl fluoride, tetrafluoroethylen ethylene, tetrafluoroethylene hexafluoropropylene, polychlorotrifluoroethylene and polyvinylidene fluoride. A white opaque film formed by using a synthesized resin containing a white pigment or a filler may be employed without any limitation.

A laminated substrate constituted by a combination of the above materials may also be employed. Typical examples of a laminated substrate include: a combination of cellulose fiber paper and synthesized paper; and a combination of cellulose synthesized paper and a plastic film.

In the invention, the thickness of the substrate is preferably 50 to 250 μm.

The presence of a layer having micro voids in the substrate is preferable for obtaining a high printing sensitivity and a high image quality without unevenness of density and white spots in image. For the layer having the micro voids, a plastic film and synthesized paper each having the micro voids therein can be employed. When the plastic film or the synthesized paper each having micro voids is employed, a mixture of a polyolefin, specifically polypropylene is preferably used as a principal material, and inorganic pigment and/or a polymer non-miscible with polypropylene is blended with the principal material to be employed as a void formation initiator. The mixture is stretched and formed into a film to obtain a plastic film or synthesized paper. When the layer is principally formed by using polyester resin, the cushion property and the thermal insulation property are inferior to those principally formed by polypropylene because of the viscoelasticity and the thermal property of polyester. Therefore, the film principally formed by the polyester resin is inferior in the printing sensitivity and the unevenness in the image.

Considering these points, the elastic modulus of the film or synthesized paper is preferably from $5\times10^8$ Pa to $1\times10^{10}$ Pa at 20° C. These film and synthesized paper shrinks by heating because they are usually produced by 2-axis stretching. The shrinking ratio of the film or the synthesized paper after standing for 60 minutes at 110° C. is 0.5 to 2.5%.

The plastic film or the synthesized paper may have a single layer structure containing the micro voids itself or a plural-layer structured. In the case of a plural-layer structure, the entire layers may contain micro voids or a layer containing no void may be included. A white pigment may be added to the plastic film or the synthesized paper as a masking agent. An additive such as a fluorescent whitening agent may also be contained for increasing the whiteness. The thickness of the layer containing the micro voids is preferably 30 to 80 μm.

Moreover, a layer of resin such as polyvinyl alcohol, polyvinylidene chloride, polyethylene, polypropylene, a modified polyolefin, polyethylene terephthalate and polycarbonate or a layer of synthesized paper may be provided on the surface of the substrate opposite to the surface on which the image receiving layer is coated, for preventing the curling. For pasting the layer, for example, known lamination methods such as a dry lamination, non-solvent (hot-melt) lamination and EC lamination are applicable, and the dry lamination method and the non-solvent lamination method are preferable. As the adhesive suitable for the non-solvent lamination method, for example, Takenate 720L, manufactured by Takeda Chemical Industries, Ltd., is cited, and that suitable for the dry lamination, for example, Takelac A969/Takenate A-5 (3/1), manufactured by Takeda Chemical Industries, Ltd., Polysol PSA SE-1400 and Vinylol PSA AV-6200, manufactured by Showa Highpolymer Co., Ltd., are cited. The using amount of such the adhesives is from about 1 to 8 g/m$^2$, preferably from 2 to 6 g/m$^2$, based on solid content.

For laminating the above plastic film and the synthesized paper or themselves, or various kinds of paper and the plastic film or the synthesized paper, an adhesive can be employed.

The surface of the substrate is preferably subjected to various kinds of primer treatments or corona discharge treatment for increasing the adhesion strength of the substrate with the intermediate layer of the dye receiving layer.

Among the above-described substrates, resin coated paper having a thickness of from 50 to 250 μm coated with plastic resin on the both surfaces thereof is preferably employed in the invention. Resin coated paper having a thickness of from 50 to 250 μm coated with polyolefin resin on the both surfaces thereof is further preferable.

The resin coated paper coated with the polyolefin resin on the both surfaces of the paper specifically preferred in the invention is described below.

The paper employed in the resin coated paper of the invention is made employing wood pulp as the principal raw material and adding according to necessity synthesized pulp of polypropylene or synthesized fiber such as nylon or polyester. As the wood pulp, LBKP, LBSP, NBKP, NBSP, LDP, NDP, LUKP and NUKP are usable, and it is preferable to mainly employ LBKP, NBSP, LBSP, NDP and LDP which contain much short fibers. The ratio of LBSP and /or LDP is preferably from 10 to 70%. In the above pulps, a chemical pulp such as sulfate pulp and sulfite pulp with a low content of impurities is preferably employed and a bleached pulp for increasing the whiteness is also useful.

To the paper, for example, a sizing agent such as a higher fatty acid and an alkylketen dimer, a white pigment such as calcium carbonate, talk and titanium oxide, a paper strengthen agent such as starch, polyacrylamide and polyvinyl alcohol, a fluorescent whitening-agent, a moisture holding agent such as polyethylene glycol, a dispersant and a softening agent such as a quaternary ammonium can be optionally added.

The degree of filtration of the pulp to be employed for paper making is preferably from 200 to 500 ml defined by the standard of CSF is preferable, and the length of the fiber after beating is preferably from 30 to 70% in terms of the sum of a 24 mesh remaining amount and a 42 mesh remaining amount defined in JIS P 8207, and a 4 mesh remaining amount is preferably not more than 20%.

The weight of the paper is preferably from 50 to 250 g/m$^2$, specifically preferably from 70 to 200 g/m$^2$, and the thickness of the paper is preferably from 50 to 250 μm.

The paper can be given high glossiness by calendar treatment before or after the paper making. The density of the paper is usually from 0.7 to 1.2 g/cm$^3$ (JIS P 8118). The stiffness of the raw paper is preferably from 20 to 200 g under the condition defined by JIS P 8143.

A surface sizing agent may be coated on the surface of the paper; as the surface sizing agent, one the same as the sizing agent added into the raw paper.

The pH of the paper is preferably from 5 to 9 measured by the hot water extraction method defined by JIS P 8113.

The polyolefin resin to be employed for covering the both surfaces of the paper is described below. Polyolefin resin usable for this purpose include polyethylene, polypropylene and polyisobutylene. Polyolefin such as a copolymer mainly composed of polypropylene is preferable, and polyethylene is specifically preferable.

Specifically preferable polyethylene is described below. The polyethylene covering the surface and the back surface of the paper is mainly a low density polyethylene (LDPE) and/or a high density polyethylene (HDPE), and another resin such as a LLDPE and polypropylene may also be partially employed.

It is preferable to add rutile type or anatase type titanium oxide into the polyolefin layer covering on the surface of the paper on which the coating-layer is provided for improving the whiteness and opacity. The content of the titanium oxide to the polyolefin is usually from 1 to 20%, and preferably from 2 to 15%.

In the polyolefin layer, a heat resistant colored pigment and fluorescent whitening agent can be added for controlling the whiteness of the background.

Examples of the colored pigment include ultramarine blue, prussian blue, cobalt blue, phthalocyanine blue, manganese blue, cerulean blue, tungsten blue, molybdenum blue and anthraquinone blue.

Examples of the fluorescent whitening agent include a dialkylaminocumalin, bis-dimethylaminostilbene, bis-methylaminostilbene, a 4-alkoxy-1,8-naphthalenedicarboxylic acid N-alkylimide, bis-benzoxazolylethylene and a dialkylstilbene.

The using amounts of the polyethylene on the surface and the back surface of the paper are decided depending on the entire layer thickness of the dye receiving layer side so as to optimize the curling of the sheet under low and high humidity conditions after providing the backing layer. The thickness of the polyethylene layer is usually 15 to 50 μm on the dye receiving layer side surface and 10 to 40 μm on the backing layer side surface. The ratio of the polyethylene on the surface to that on the back surface is preferably decided for controlling the curl which is varied depending on the kind and thickness of the dye receiving layer and the thickness of the raw paper. The ratio of polyethylene, surface/back, is approximately from 3/1 to 1/3 in thickness.

The foregoing polyethylene laminated paper preferably has characteristics of the following 1 to 7.

1. Tensile strength: Preferably from 19.6 to 294 N in the longitudinal direction and from 9.8 to 196 N in the lateral direction in the strength defined in JIS P 8113;

2. Tear strength: Preferably from 0.20 to 2.94 N in the longitudinal direction and from 0.098 to 2.45 N in the lateral direction in the-strength defined in JIS P 8116;

3. Compressive elasticity: Preferably 9.8 $kN/cm^2$ ;

4. Opacity: Preferably not less than 80%, and specifically preferably from 85 to 98% measured by the method defined in JIS P 8138;

5. Whiteness: Preferably L*=80 to 96, a*=−3 to +5, b*=−7 to +2 in L*,a*,b* defined in JIS Z 8727;

6. Clark's stiffness: A substrate having a Clark's stiffness of from 50 to 300 $cm^3/100$ in the conveying direction of the recording paper is preferable;

7. The moisture content of the paper is preferably from 4 to 10% of the raw paper; and 8. Glossiness before provision of the dye receiving layer is preferably from 10 to 90% of the 75° mirror face glossiness.

In the image receiving sheet of the invention, the method for coating the layers to be provided according to necessity such as the porous layer and a subbing layer onto the substrate can be optionally selected from known methods. As the preferable methods, the coating liquids for forming each layer are coated on the substrate and dried. In the coating method, two or more layers can be simultaneously coated, and the coating method in which the entire layers are coated at once is specifically preferable.

A roller coating method, a rod bar coating method, an air knife coating method, a spray coating method, a curtain coating method and an extrusion coating method using a hopper described in U.S. Pat. No. 2,681,294 are preferably applied.

(Thermal Insulating Layer)

The thermal insulation property of the thermal insulating layer of the invention is provided by various methods, for example, a method to mix inorganic microparticles.

Examples of inorganic microparticles include white inorganic pigments, for example: light calcium carbonate, heavy calcium carbonate, magnesium carbonate, kaolin, clay, talc, calcium sulfate, barium sulfate, titania (titanium dioxide), zinc oxide, zinc hydroxide, zinc sulfide, zinc carbonate, hydrotalcite, aluminum silicate, synthesized amorphous silica, colloidal silica, alumina, colloidal alumina, pseudoboehmirte, aluminum hydroxide, lithopone, zeolite and magnesium hydroxide.

The inorganic microparticles may be employed either in a state of uniformly dispersed in a binder in a form of primary particles or in a form of secondary coagulated particle. The later is preferable from the viewpoint of attaining the high heat insulation and cushion property.

The inorganic microparticles may have any shape such as spherical, rod-like, needle-like, planar, rosary-like and hollow particle without any limitation, and their combination is also employable.

Among the foregoing inorganic microparticles, silica, alumina, titania and a combination thereof are preferable for the inorganic microparticles of the invention from the viewpoint of cost performance. The average diameter of the primary particles is preferably from 3 to 100 nm since the porous structure having high thermal insulation property can be easily formed by such particles.

As the inorganic microparticles, solid microparticles selected from silica, alumina and hydrated alumina is specifically preferable.

Silica synthesized by an ordinary wet method, colloidal silica and silica synthesized by a gas phase method are preferably employed in the invention, and the microparticles of silica synthesized by the gas phase method is specifically preferably employed in the invention. The silica synthesized by gas phase method is preferable since not only high void ratio is obtained but also coarse coagula tends not to be formed.

Alumina and the hydrated alumina may be either crystalline or amorphous, and optional shaped alimina such as irregular particles, spherical particles, needle-like particles and hollow particles may be employed.

Microparticles of the invention are preferably dispersed in a state of primary particles before being mixed with a binder which will be described later.

The diameter of the primary particle is preferably not more than 100 nm as described above. For example, in the case of silica microparticles prepared by the gas phase method, the average diameter of the primary particles in the dispersed state (the particle diameter in the dispersed liquid before coating) is preferably from 3 to 20 nm, and most preferably from 4 to 20 nm.

Examples of the silica synthesized by the gas phase method having an average diameter of the primary particle of from 4 to 20 nm, which are most preferably employed, include Aerosil manufactured by Aerosil Co., Ltd., Cabosil manufactured by Cabot Co., Ltd., and Rheoloseal manufactured by Tokuyama Corp., they are available on the market. Such the gas phase method silica microparticles can be relatively easily dispersed by near primary particle state by suction dispersing by a jet stream inductor mixer manufactured by Mitamura Riken Kogyo Co., Ltd.

The amount of added inorganic microparticles is generally 3 to 30 g per 1 $m^2$ of the image receiving sheet, and preferably 5 to 25 g per 1 $m^2$ of the image receiving sheet. The ratio of the inorganic microparticles to the above mentioned binder is normally 2:1 to 20:1 by weight and preferably 5:1 to 12:1 by weight.

When a thermal insulation layer is formed according to this method, the void ratio of the thermal insulation layer is preferably adjusted to not less than 40%, and more preferably adjusted to 40 to 95%. When the void ratio is less than 40%, the properties of thermal insulation and cushion are not fully attained, and when the void ratio is more than 95%, degradation of mechanical strength of the sheet becomes notable while the thermal insulation property is not fully increased. The void ratio referred to in the invention represents a ratio of the total volume of the voids based on the volume of the thermal insulation layer. The void ratio may be optionally adjusted according to the kind of inorganic microparticles or the kind of binder.

As a method to provide a thermal insulation property to the image receiving sheet, hollow particles are preferably used. The diameter of a hollow particle is preferably 0.1 to 60 μm. When the diameter of the hollow particle is smaller than 0.1 μm, sufficient properties of thermal insulation and cushion are not obtained, and when it is more than 60 μm, flatness of the constituting layers may be lost, resulting in lowering the quality of the image. The diameter is specifically preferably 0.3 to 20 μm. The void ratio in a hollow particle is preferably 40% or more by volume. When it is less than 40%, sufficient properties of thermal insulation and cushion are not obtained. The void ratio in a particle is preferably 50% or more. In order to increase stability of hollow particles in a coating liquid, the surfaces of hollow particles are preferably covered with, for example, inorganic pigment, to increase relative gravity of the hollow particles. As the inorganic pigment, any of the pigments listed above as inorganic microparticles are applicable to cover the surfaces of hollow particles by means of, for example, thermal adhesion. Hollow particles may be formed by microcapsuling a low boiling point solvent such as butane or pentane with a resin or a copolymer such as polyvinylydene chloride, polyacrylonitrile, or methylmethacrylate. In the invention, preliminarily foamed particles or non-foamed particles may be added to the coating liquid, however, preliminarily foamed particles are preferably used because it is rather difficult to uniformly foam non-foamed particles, resulting in degrading the quality of the image. The content of hollow particles is preferably 10 to 90% by weight based on the weight of the thermal insulation layer after dried. When the content is less than 10%, sufficient properties of thermal insulation and cushion are not obtained, and when it is more than 90%, these properties may not be enhanced any more. The content of hollow particles is specifically preferably 20 to 85% by weight.

Another method to provide a thermal insulation property includes a method disclosed in JP-A No. 11-301124, in which a coating liquid is mechanically foamed, for example, by stirring.

Any one of the above methods is applicable. The most important properties of a thermal insulation layer include a high thermal insulation necessary to attain a high printing sensitivity and a function to provide a close contact of the image receiving layer to the thermal transfer ink sheet while ink is being transferred to the image receiving sheet. In this point of view, the thermal conductivity of the entire thermal transfer ink sheet is preferably not more than 0.35 W/mK and the cushion transformation ratio is preferably 5 to 60%. The thermal conductivity represents an amount of heat flow per second through 1 $m^2$ of a plate measuring 1 m thickness with a 1° C. difference in temperature between the both ends of the plate. Also, the cushion transformation ratio herein mentioned represents a ratio of the thickness of the image receiving sheet under pressure of 100 g/$cm^2$ to the thickness without pressure under a condition of 23° C.-55% RH.

The binder used in the thermal insulation layer of the invention is preferably a hydrophilic binder which will be described below.

(Intermediate Layer)

In order to enhance the durability of an image, it is important to provide an intermediate layer between the thermal insulation layer and an image receiving layer.

The functions of the intermediate layer of the invention include providing: resistivity against solvents, a barrier for diffusion of dye under storage of an image at high temperature or under high humidity, strong adhesion between layers, whiteness of the sheet, an anti-glare property, prevention of unevenness of a sheet surface or an antistatic property, however, the invention is not limited thereto. Any known methods to provide an intermediate layer are applicable.

The binder used in the intermediate layer of the invention is preferably a hydrophilic binder which will be described below.

A fluorescent whitening agent may be contained in the intermediate layer of the invention. Any known fluorescent whitening agents are applicable, for example, stilbene, distilbene, benzoxazole, styryloxazole, pyreneoxazole, cumarin, aminocumarin, imidazole, benzimidazole, pyrazoline, and distyrylbiphenyl. Whiteness degree of the image receiving sheet is adjusted by selecting a kind and an adding amount of the fluorescent whitening agent.

Any known methods for adding a fluorescent whitening agent are applicable without any limitation. The examples of adding method include a method by dissolving in water, a method by crushing and dispersing by a ball mill or a colloid mill, a method in which the whitening agent is dissolved in a high-boiling point solvent and mixed with a hydrophilic colloid solution to form an oil-in-water dispersion for addition and a method by impregnating in a polymer latex.

Titanium oxide may be added to the intermediate layer in order to reduce the glare and to cover the unevenness of the substrate sheet. The use of the titanium oxide is preferable since the selectivity of the substrate sheet is expanded.

Titanium oxides include rutile type titanium oxide and anatase type titanium oxide. Among these, anatase type titanium-oxide having shorter wavelength of UV absorption compared to that of rutile type titanium oxide is preferable in view of the whiteness and the effect of a fluorescent whitening agent. When titanium oxide is difficult to be dispersed in the binder, the titanium oxide can be dispersed by using titanium oxide treated by a hydrophilizing treatment or by using known dispersant such as a surfactant or ethylene glycol. The adding amount of the titanium oxide is preferably from 10 to 400 weight parts in 100 weight parts of the solid portion of the resin.

For providing an antistatic property to the intermediate layer, a usually known electroconductive material such as an electroconductive inorganic filler, an electroconductive organic material such as polyaniline sulfonate can be optionally selected and employed together with the binder resin. The thickness of the intermediate layer is preferably from 0.1 to 10 μm.

When the thermal insulation layer is formed so as to have a porous nature by adding inorganic microparticles or by mechanically agitating the coating liquid, micorparticles such as hollow particles are preferably added to the intermediate layer for increasing the moisture proof property and for obtaining high printing sensitivity by sealing the voids in the thermal insulation layer. The hollow particle may be employed alone or in combination with the above mentioned titanium oxide.

[Image Receiving Layer]

The image receiving layer of the invention preferably contains a metal ion-containing compound reacting with a chelate formable dye to form a chelate compound or a release agent in order to enhance durability of an image under storage or to improve releasing property of the image receiving sheet from the ink sheet.

The binder resin, the metal ion-containing compound reacting with a chelate formable dye to form a chelate compound and the release agent to be used in the image receiving layer of the invention will be described below.

(Binder Resin)

One of the characteristic features of the image receiving sheet of the invention is that the thermal insulation layer, the intermediate layer and the image receiving layer are provided by an aqueous coating method, and the binder to be used in these layers are preferably a hydrophilic binder. Also, a hydrophobic polymer dispersable in an aqueous solvent is preferably employed. The binder for layers except for the above mentioned layers may be a hydrophilic binder, a hydrophobic binder or a mixture thereof.

Examples of a hydrophobic binder include: a polyolefine resin such as polypropylene; a halogenated polymer such as polyvinyl chloride or polyvinylidene chloride; a polyester resin such as polyethylene terephthalate or polybutylene terephthalate; a polystyrene resin; a polyamide resin; a copolymer of olefin (such as ethylene or propylene) and other vinyl monomer; ionomer; a cellulose resin such as cellulose diacetate; and a polycarbonate resin. Of these, preferable is a vinyl resin and a polyester resin. These resins may be used alone or in combination of a plurality of resins.

Examples of a hydrophilic resin used in the thermal insulation layer, the intermediate layer or the image receiving layer include: gelatin, polyvinyl alcohol, polyethyleneoxidek polyvinylpyrrolidone, pullulan, carboxymethyl cellulose, hydroxyethyl cellulose, dextran, the dextrin, polyacrylic acid and its salt, agar, κ-carrageenan, λ-carrageenan, ι-carrageenan, casein, xanthene gum, locust bean gum, alginic acid, gum arabic, polyalkyleneoxide copolymer disclosed in JP-A Nos. 7-195826 and 7-9757, water-soluble polyvinyl butyral, a homopolymer or a copolymer of a vinyl monomer having a carboxyl group or a sulfuric acid group disclosed in JP-A No. 62-245260. The binders may be used alone or in combination of two or more binders. The. hydrophilic binder preferably used in the invention is polyvinyl alcohol and/or gelatin.

Any gelatin prepared via liming, acid treating or by other methods are applicable.

The above polyvinyl alcohol includes modified polyvinyl alcohols such as a cationic modified polyvinyl alcohol, an anionic modified polyvinyl alcohol having an anionic group, and a silyl modified polyvinyl alcohol substituted by a silyl group.

The average polymerization degree of the polyvinyl alcohol to be employed together with the emulsion resin is preferably not less than 300, and specifically preferably from 1,000 to 5,000. The saponification degree is preferably from 70 to 100% by mole, and specifically preferably from 80 to 99.5% by mole.

When a hydrophilic binder or a hydrophobic binder is employed in combination with the emulsion resin, the ratio of the emulsion resin prepared by emulsion polymerization by the polymer dispersant containing a hydroxyl group in the binder is preferably not less than 5% by weight, and specifically preferably not less than 10% by weight.

The above mentioned cationic polymer used in the invention will be described.

The cationic polymer use in the invention is a polymer having a primary, secondary or tertiary amine group, a quaternary ammonium group or a quaternary phosphonium group on the principal chain or a side chain thereof.

Examples of the cationic polymer include polyethyleneimine, polyallylamine, polyvinylamine, a dicyandiamide-.polyalkylene polyamine condensation product, a polyalkylene polyamine dicyandiamide ammonium salt condensation product, a dicyandiamide formalin condensation product, an epichlorohydrine·dialkylamine addition polymer, a diallyldimethylammonium chloride polymer, a diallyldimethylammonium chloride·$SO_2$ copolymer, polyvinylimidazole, a vinylpyrrolidone·vinylimidazole copolymer, polyvinylpyridine, polyamidine, chitosan, cationic starch, a vinylbenzyltrimethylammonium chloride polymer, a (2-methacroyloxyethyl)trimethylammonium chloride polymer and a dimethylaminoethyl methacrylate polymer.

The cationic polymer of the invention is preferably unswellable, and a cationic polymer copolymerized with an acrylic acid is specifically preferred. As the acrylic acid, an acrylic acid ester and an acrylamide are applicable and butyl acrylate and hydroxyethylmethyl acrylate are preferable.

Moreover, cationic polymers described in "Kagaku Kogyo Joho" published on August 15 and 25 in 1998, and polymer dye-fixing agents described in "Kobunshi Yakuzai Nyumon" published by Sanyo Chemical Industries, Ltd., may be listed.

The weight average molecular weight of the cationic polymer employable in the invention is preferably from 2,000 to 500,000, and more preferably from 3,000 to 100,000.

The cationic polymer employable in the invention may be (i) previously added to the coating liquid and then coated and dried; or (ii) added by immersing the coated and dried image receiving layer in an aqueous solution of the cationic polymer.

When the cationic polymer employable in the invention is previously added to the coating liquid, the cationic polymer may be uniformly added to the coating liquid or also may be added as composite particles with inorganic microparticles. Methods for forming the composite particles of inorganic particles and the cationic polymer include: (i) a method in which the inorganic microparticles are mixed with the cationic polymer so that the surfaces of the microparticles are covered with the cationic polymer by absorption; (ii) a method in which the above mentioned covered microparticles are further coagulated so as to form a higher order composite particle; and (iii) a method in which thus obtained coarse particles are dispersed as uniform particles using a homogenizer.

The cationic polymer of the invention is usually water-miscible since it has a water-soluble group, however, there are some cationic polymers which are not soluble in water according to the composition of the copolymer. With respect to the production processes, the water soluble cationic polymer is preferable, however, even if a cationic polymer is insoluble in water, it may be dissolved in aqueous solution by using a water-miscible organic solvent.

The water-miscible organic solvent is an organic solvent capable of being dissolved in water in a ratio of approximately not less than 10%, for example: alcohols such as methanol, ethanol, iso-propanol and n-propanol; glycols such as ethylene glycol, diethylene glycol and glycerin; esters such as ethyl acetate and propyl acetate; ketones such as acetone and methyl ethyl ketone; and amides such as N,N-dimethylformamide. The amount of the water-miscible organic solvent is preferably smaller than that of water.

The cationic polymer is usually employed within the range of from 0.1 to 10 g, and preferably from 0.2 to 5 g, per square meter of the thermal transfer image receiving sheet.

<Metal Ion-containing Compound Capable of Forming a Chelate Compound By Reaction With a Chelate Formable Dye>

As the metal ion-containing compound capable of forming a chelate compound reacting with a chelate formable dye (hereinafter referred to as a metal source) contained in the image receiving layer of the thermal transfer image receiving sheet of the invention, an inorganic or organic salt of a metal ion and a metal complex are employable, among them an inorganic salt is preferred. Mono-valent and multi-valent metals included in Groups I through VIII of the periodical table are usable as the metal, and Al, Co, Cr, Cu, Fe, Mg, Mn, No, Ni, Sn and Zn are preferable and Ni, Cu, Cr, Co and Zn are specifically-preferable.

Concrete examples of the metal source include an inorganic salt, a salt of an aliphatic acid such as acetic acid or stearic acid, and a salt of an aromatic carboxylic acid such as benzoic acid or alicylic acid, with $Ni^{2+}$, $Cu^{2+}$, $Cr^{2+}$, $Co^{2+}$ or $Zn^{2+}$.

In the invention, a complex represented by the following Formula I is specifically preferably employed since the complex can be stably added to the image receiving layer and is substantially colorless.

$$[M(Q_1)_X(Q_2)_Y(Q_3)_Z]^{P+}(L^-)_P \qquad \text{Formula I}$$

In the above formula, M is a metal ion, preferably $Ni^{2+}$, $Cu^{2+}$, $Cr^{2+}$, $Co^{2+}$ or $Zn^{2+}$, and $Q_1$, $Q_2$ and $Q_3$ each represent a coordination compound capable of forming a coordinate bond with the metal ion represented by M. $Q_1$, $Q_2$ and $Q_3$ may be the same or different. The coordination compound can be selected, for example, from those described in "Kireito Kagaku (Science of Chelate)" published by Konando. $L^-$ is an organic anionic group such as a tetraphenyl boron anion and an alkylbenzenesulfonate anion. X is an integer of 1, 2 or 3, Y is 0, 1 or 2 and Z is 0 or 1, and they are decided depending on that the complex represented by Formula I is tetradentate coordination or hexadentate coordination complex or the number of ligand represented by $Q_1$, $Q_2$ and $Q_3$. P is an integer of 1 or 2. As concrete examples of such-metal source, compounds described in U.S. Pat. No. 4,987,049 and Compounds 1 through 51 described in JP-A 10-67181 can be cited.

The adding amount of the metal source is usually from 5 to 80% and further preferably from 10 to 70% based on the weight of the binder of the image receiving layer. The adding amount of the metal source in the invention is preferably from 0.5 to 20 g/m$^2$, and further preferably from 1 to 15 g/m$^2$.

<Release Agent>

Addition of a release agent to the image receiving layer for preventing the thermal fusion with the ink layer of the thermal transfer ink sheet on the occasion of printing is one of the characteristics of the image receiving layer of the invention. A silicone emulsion release agent or a water-soluble release agent is preferably used.

A phosphoric acid ester plasticizer, a fluorine-containing compound and silicone oil (including a reaction curable silicone) can be employed for the release agent. Of these, silicone oil is preferable. As the silicone oil, various modified silicone including dimethylsilicone can be employed. In concrete, an amino-modified silicone, an epoxy-modified silicone, an alcohol-modified silicone, a vinyl-modified silicone or a urethane-modified silicone are usable. These silicones may be blended or polymerized via various reactions. The release agent is used alone or in combination of two or more kinds thereof. The adding amount of the release agent is preferably from 0.5 to 30 weight parts in 100 weight parts of the resin constituting the image receiving layer. When the adding amount of the release agent is out of the above range, the fusion of the thermal transfer ink sheet with the image receiving sheet tends to occur and the printing sensitivity may be lowered. The release agent may be separately provided as a releasing layer on the image receiving layer in which no release agent is contained.

In the invention, a silicone emulsion release agent is preferably employed. The silicone emulsion release agent is a silicone emulsion prepared by emulsifying silicone oil by various emulsifying agents. A silicone emulsion release agent of oil emulsion (O/W) type is preferred. In concrete, KM786, KM578 and KM860, manufactured by Shin-Etsu Chemical Co., Ltd., are usable. The emulsion type silicone release agent may be employed alone or in combination of two or more kinds thereof. The silicone emulsion type release agent may be employed together with another silicone oil release agent.

These release agents may be separately provided as a releasing layer provided on the image receiving layer containing no release agent.

<Silicone Surfactant>

The image receiving layer of the invention preferably contains a silicone surfactant.

In the invention, any known silicone surfactants can be employed. For example, those disclosed in "Kinousei Kaimenn Kasseizai (Functional Surfactant)" edited by M. Tsunoda, Section 6, August 2000, are preferably employed. In concrete, Emalex SS-5050K and Emalex SS-5602, manufactured by Nihon Emulsion Co., Ltd., are employable.

<Fluorinated Surfactant>

In the image receiving layer of the invention preferably contains a fluorinated surfactant.

In the invention, any known fluorinated surfactant can be employed. For example, those disclosed in "Kinnousei Kaimenn Kasseizai (Functional Surfactant)" edited by M. Tsunoda, Section 5, August 2000, are preferably employed. In concrete, Ftergent series manufactured by Neos Co., Ltd. and FC-4430 manufactured by Sumitomo 3M Co., Ltd. are employable.

The image receiving layer of the invention is preferably comprised of two or more sublayers. The image receiving sublayer farthest from the substrate preferably contains a release agent and one of the other sublayers preferably contains a compound having a metal ion which forms a chelate compound by reacting with a colorant capable of forming a chelate. Thus prepared image receiving layer is preferable for attaining high durability of an image under storage and for attaining an optimal releasing property.

<Hardening Agent>

In the image receiving sheet of the invention, one of the layers formed by the aqueous coating method preferably contains a hardening agent. The hardening agent can be added in the preparation step of the coating liquid or in the coating step.

The hardening agent usable in the invention is not specifically limited as long as it is reactive with the binder and conducts a hardening reaction. Boric acid and its salt, and an epoxy type hardening agent are preferable, and other known hardening agent may also be employed. Generally, a hardening agent is a compound having a group capable of reacting with the binder or a compound capable of accelerating the reaction between different groups in the hydrophilic binder, and is optionally selected for use corresponding to the kind of the binder. Concrete examples of the hardening agent include epoxy type hardening agents (such as diglycidyl ethyl ether, ethylene glycol diglycidyl ether, 1,4-butanediol glycidyl ether, 1,6-diglycidylcyclohexane, N,N-diglycidyl-4-glycidyloxyaniline, sorbitol polyglycidyl ether and glycerol polyglycidyl ether); aldehyde hardening agents (such as formaldehyde and glyoxal); reactive halogen hardening agents (such as 2,4-dichloro-4-hydroxy-1,3,5-s-triazine); reactive vinyl compounds (such as 1,3,5-trisacryloyl-hexahydro-s-triazine and bisvinylsulfonylmethyl ether); isocyanate compounds, zirconyl sulfate and aluminum alum.

"Boric acid and its salt" represents an oxygen acid containing a boron atom as the central atom and a salt thereof. Concretely, orthoboric acid, diboric acid, metaboric acid, tetraboric acid, pentaboric acid and octaboric acid and a salt thereof are included.

The boric acid and its salt having a boric atom as a hardening agent may be employed as a solution using single organic solvent or as an aqueous solution, and may be employed as a solution containing a mixture of two or more kinds of boric compounds. An aqueous solution of a mixture of boric acid and borax is specifically preferable.

Though boric acid and borax each can be added only as a diluted aqueous solution, a concentrated aqueous solution can be obtained by mixing these two compounds so that a concentrated coating liquid can be prepared. Moreover, it is an advantage that the pH of the aqueous solution can be relatively freely controlled.

The total using amount of the hardening agent is preferably from 1 to 1,000 mg per 1 g of the binder. The supplying amount of the hardening agent is preferably from 100 to 1,000 mg per 1 g of the binder.

<pH of Image Receiving Layer Coating Liquid>

The pH value of the image receiving layer coating liquid for forming the thermal transfer image receiving layer is preferably not more than 8.0, and more preferably from 5.0 to 8.0, for enhancing the effects of the invention.

[Coating Method]

In the production process of the image receiving layer of the invention, all the layers of thermal insulation layer through image receiving layer are formed by an aqueous coating method, however, other layers which may be additionally provided when necessary are formed by using a method optionally selected from known methods.

In the production process of the image receiving sheet of the invention, preferable is to form all the layers provided on the surface of a substrate having the image receiving layer by an aqueous coating method.

Also, preferable is to form a pair of adjacent layers by a simultaneous multilayer coating method, further a preferable is to form all the layers provided on the surface of a substrate having the image receiving layer by a simultaneous multilayer coating method.

By employing the above mentioned coating processes, highly uniform and sufficiently flat coating layers are formed.

A coating method employed in the invention is not specifically limited, however, a roller coating method, a rod bar coating method, an air knife coating method, a spray coating method, a curtain coating method and an extrusion coating method using a hopper described in U.S. Pat. No. 2,681,294 are preferably applied.

In the production process of the image receiving sheet of the invention, when two or more layers are simultaneously coated, it is preferable to obtain uniform and homogeneous layers that the following relationship is satisfied: $\eta_2 > \eta_1$, wherein $\eta_1$ represents a viscosity of a coating liquid of an undermost layer and $\eta_2$ represents a viscosity of a coating liquid of any one of other layers.

In the above relationship, the difference in the viscosities of $\eta_2$ and $\eta_1$ is preferably 2 mPa·s or more and more preferably 5 mPa·s or more when the temperature of the coating liquid is 40° C. The absolute viscosity value of $\eta_1$ is preferably not more than 100 mPa·s and that of $\eta_2$ is preferably 15 mPa·s or more, but not more than 500 mPa·s. The temperature of the coating liquid is preferably 25 to 90° C. and more preferably 30 to 80° C.

In the invention, the viscosities of the coating liquids prescribed above are easily obtained by adding a known viscosity improver, for example, a water-soluble viscosity improver mainly containing a copolymer of styrene and a sodium maleate salt, or an inorganic salt which is added within a range where the inorganic salt may not affect the property of the coating liquid.

In the production process of the image receiving sheet of the invention, when two or more layers are simultaneously coated, it is preferable to obtain uniform and homogeneous layers that coating is conducted under the condition where Formulas (1) and (2) are simultaneously satisfied in every adjacent pair of layers:

$$Ts(L) \geqq Ts(U) \quad \text{Formula (1)}$$

$$Td(L) \geqq Td(U) \quad \text{Formula (2)}$$

wherein:

Ts(L) represents a static surface tension of a coating liquid of a lower layer of the adjacent pair of layers;

Ts(U) represents a static surface tension of a coating liquid of an upper layer of the adjacent pair of layers;

Td(L) represents a dynamic surface tension of the coating liquid of the lower layer of the adjacent pair of layers; and Td(U) represents a dynamic surface tension of the coating liquid of the upper layer of the adjacent pair of layers.

The Ts(L) value is preferably the same or larger than the Ts(U) value, and more preferably the difference in these two values is 2 mN/m or more at the coating liquid temperature of 40° C. Also, the Td(L) value is preferably the same or larger than the Td(U) value, and more preferably the difference in these two values is 10 mN/m or more at the coating liquid temperature of 40° C.

In the invention, the surface tension of the coating liquid is adjusted by adding one of the variety of surfactants, for example, a fluorine-containing surfactant.

It takes a certain period of time until a stable surface tension of a coating liquid is obtained after a new surface of the coating liquid is formed. A dynamic surface tension is defined as a non-equilibrium surface tension in which the surface tension is changing with time due to, for example, (i) evaporation of the solvent in the coating liquid; (ii) orientation rate of the surfactant in the coating liquid; or (iii) different orientation intensity due to different surfactants at the surface of the coating liquid, while the coating liquid is being coated and the coated area is expanding on the substrate.

The dynamic surface tension of the invention is determined by means of known methods, for example, a meniscus method, a dropping method, a γ/A curvilinear method, an oscillating jet method, a maximum bubble pressure method, and a curtain applicator method (J. Fluid Mech., vol.112, pp443-458 (1981)). For example, a dynamic surface tension of a coating liquid is determined from the angle a between a plumb line and a tangential line at a specified point of a stationary wave of Sinous mode which appears together with Varicose mode when a bar is calmly inserted in a curtain flow of the coating solution so as not to make contact with each other of the two free surfaces of the front and the back of the curtain flow.

The measuring method of static surface tension is described in general publications on surface chemistry and colloid chemistry, for example, in "Shin-Jikkenkagakukoza" (A new edition for experimental chemistry) vol.18 (Interface and Colloid), pp68-117, edited by The Chemical Society of Japan, and published by Maruzen Co., Ltd. Specifically, a ring method (DuNouy method) and a plate method (Wilhelmy method) are applicable to measure the static surface tension.

In the production process of the image receiving sheet of the invention, it is preferable for obtaining uniform and homogeneous coating layers that a step of setting by cooling the coated layers (hereafter referred to as a cooling-setting step or a setting step) is provided after the coating steps and before the drying step. Herein, a cooling-setting step represents a step in which the coated layers are cooled by blowing cold air in order to increase the viscosity of the coated compositions and to accelerate gelation of the layers by which migration of the components in each layer is suppressed. The temperature of the cold wind is preferably 25° C. or less and still more preferably 10° C. or less. The duration of blowing the cold air depends on the coating rate and the conveying rate, however, the duration is preferably 10 to 120 seconds. As a method to enhance setting of the coated composition, addition of various gelatinizers, such as gelatin, pectin, agar, carrageenan, and gellun gum, is preferably applicable.

In the production process of the image receiving sheet of the invention, it is preferable for increasing adhesion between the coated layers that an aging step is provided after the coating steps, the setting step and the drying step, in which the coated layers are heated for a certain period of time. The aging step herein referred to is a step in which the image receiving sheet after dried is heat treated at a constant temperature under a constant humidity for a certain period of time in order to homogenize the degree of chemical reaction in the coated layers, for example, a linking reaction. The period of time until the start of aging after the drying step is over is preferably not more than two weeks and more preferably not more than one week. The aging condition is preferably: a temperature of 30 to 80° C., and a relative humidity of 20 to 80%. The duration of ageing depends on the temperature and the humidity of aging, however, it is preferably 1 to 240 hours.

The thermal transfer ink sheet is described below, which is employed together with the thermal transfer image receiving sheet according to the invention for image formation.

<<Thermal Transfer Ink Sheet>>

(Substrate Sheet)

In the invention, materials known as the substrate sheet for usual thermal transfer ink sheet can be employed. Examples of the preferable substrate sheet include (i) thin paper such as glassine paper, condenser paper and paraffin paper; (ii) polyester having high heat resistivity such as polyethylene terephthalate, polyethylene naphthalate, polybutylene terephthalate, polyphenylene sulfide, polyether ketone and polyether sulfone; (iii) stretched or non-stretched films of plastics such as polypropylene, a fluororesin, polycarbonate, cellulose acetate, a polyethylene derivative, polyvinyl chloride, polyvinylidene chloride, polystyrene, polyamide, polyimide, polymethylpentene and an ionomer; and (iv) a laminated product of these materials. The thickness of the substrate sheet can be selected according to the material so that the strength and the heat resistive property is optimized, and a substrate sheet having a thickness of 1 to 100 μm is preferably employed.

When the adhesion between the substrate sheet and the ink sheet formed on the sheet is insufficient, the surface is preferably subjected to a primer treatment or a corona treatment.

(Ink Layer and Colorant)

In the invention, the ink sheet constituting the thermal transfer ink sheet is a heat sublimation colorant layer containing a dye and a binder. The colorant to be used in the ink layer of the invention may be employed alone or in combination of plural kinds thereof.

The colorant employable in the invention is described below.

In the thermal transfer ink sheet of the invention, two or more colorant-containing areas different in the hue may be provided, for example, (i) an embodiment in which the colorant containing areas contain an yellow colorant-containing area, a magenta colorant-containing area and a cyan colorant-containing followed by a no colorant area, (ii) an embodiment in which the colorant-containing area is constituted by a black colorant-containing area followed by a no colorant area, and (iii) an embodiment in which the colorant-containing areas contain a yellow colorant-containing area, a magenta colorant-containing area, a cyan colorant-containing area, a black colorant-containing area followed by a no colorant area.

For the colorant to be employed in the thermal sublimation colorant layer, any known colorant such as an azo colorant, an azomethine colorant, a methine colorant, an anthraquinone colorant, a quinophthalone colorant and a naphthoquinone colorant are usable, however, the invention is not limited thereto. In concrete, a yellow colorant such as Holonbrilliant Yellow 6GL, PTY-52 and Macrolex Yellow 6G; a red colorant such as MS Red G, Macrolex Red Violet R, Seles Red 7B, Samalon Red HBSL and SK Rubin SEGL; and a blue colorant such as Kayaset Blue 714, Waxolin Blue AP-FW, Holon Brilliant Blue S-R, MS Blue 100 and Daito Blue No. 1 are cited.

As a chelate formable thermal diffusion colorant, various known compounds can be optionally selected for use without any limitation as long as the colorant can be thermally transferred. For example, the cyan, magenta and yellow colorants described in JP-A Nos. 59-78893, 59-109349, 4-94974 and 4-97894, and Japanese Patent No. 2856225 are employable.

For example, a compound represented by the following Formula (1) can be employed as the chelate formable cyan colorant.

Formula (1)

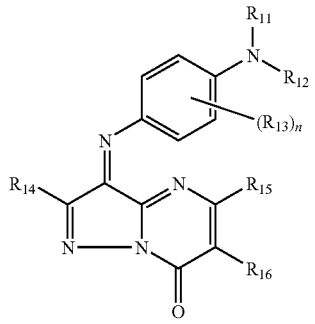

In the above Formula (1), $R_{11}$ and $R_{12}$ each represent a substituted or unsubstituted aliphatic group; $R_{11}$ and $R_{12}$ may be the same or different. Examples of the aliphatic group include: an alkyl group, a cycloalkyl group, an alkenyl group and an alkynyl group. Examples of the alkyl group include: a methyl group, an ethyl group and an i-propyl group, and examples of a group capable of being a substituent of the alkyl group include: a straight or branched chain alkyl group (such as a methyl group an ethyl group, an i-propyl group, a t-butyl group, an n-dodecyl group and a 1-hexylnonyl group); a cycloalkyl group (such as a cyclopropyl group, a cyclohexyl group, a bicylo[2.2.1]heptyl group, and an adamantyl group); an alkenyl group (such as a 2-propylen group and an oleyl group); an aryl group (such as a phenyl group, an orthotolyl group, an orthoanisyl group, a 1-naphthyl group and a 9-anthranyl group); a heterocyclic group (such as a 2-tetrahydrofuryl group, a 2-thiophenyl group, a 4-imidazolyl group and 2-pyridyl group); a halogen atom (such as a fluorine atom, a chlorine atom and a bromine atom); a cyano group; a nitro group; a hydroxyl group; a carbonyl group (for example, an alkylcarbonyl group such as an acetyl group, a trifluoroacetyl group and a pivaloyl group, an arylcarbonyl group such as a benzoyl group, a pentafluorobenzoyl group and a 3,5-di-t-butyl-4-hydrox-ylbenzoyl group); an oxycarbonyl group (for example, an alkoxycarbonyl group such as a methoxycarbonyl group, a cyclohexyloxycarbonyl group and an n-dodecyloxycarbonyl group, an aryloxycarbonyl group such as a phenoxycarbonyl group, 2,4-di-t-amylphenoxycarbonyl group and 1-naphthyloxycarbonyl group, and a heterocycloxycarbonyl group such as a 2-pyridyloxycarbonyl group and 1-phenylpyrazolyl-5-oxycarbonyl group); a carbamoyl group (for example, an alkyl carbamoyl group such as a dimethylcarbamoyl group and a 4-(2,4-di-t-amylphenoxy)butylaminocarbamoyl group, and an arylcarbamoyl group such as a phenylcarbamoyl group and a 1-naphthylcarbamoyl group); an alkoxyl group (such as a methoxy group and a 2-ethocyethoxy group); an aryloxy group (such as a phenoxy group, a 2,4-di-t-amylphenoxy group and a 4-(4-hydroxyphenylsulfonyl)phenoxy group); a hetercycloxy group (such as a 4-pyridyloxy group and a 2-hexahydropyranyloxy group); a carbonyloxy group (for example, an alkylcarbonyloxy group such as an acetyloxy group, a trifluoroacetyloxy group and a pivaloyloxy group, and an arylcarbonyloxy-group such as a benzoyloxy group and a pentafluorobenzoyloxy group); a urethane group (for example, an alkylurethane group such as an N,N-dimethylurethane group, and an arylurethane group such as an N-phenylurethane and an N-(p-cyanophenyl)urethane group); a sulfonyloxy group (for example, an alkylsulfonyloxy group such as a methanesulfonyloxy group, a trifluoromethanesulfonyloxy group and a n-dodecanesulfonyloxy group, and an arylsulfonyloxy group such as a benzenesulfonyloxy group and a p-toluenesulfonyloxy group); an amino group (for example, an alkylamino group such as a dimethylamino group, a cyclohexylamino group and an n-dodecylamino group, and an arylamino group such as an aniline group and p-t-octylanilino group); a sulfonylamino group (for example, an alkylsulfonylamino group such as a methanesulphonylamino group, a heptafluoropropanesulfonylamino group and an n-hexadecylsulfonylamino group, and an arylsulfonylamino group such as a p-toluenesulfonylamino group and a pentafluorobenzenesulfonylamino group); a sulfamoylamino group (for example, an alkylsulfamoylamino group such as an N,N-dimethylsulfamoylamino group, and an arylsulfamoylamino group such as an N-phenylsulfamoylamino group); an acylamino group (for example, an alkylcarbonylamino group such as an acetylamino group and a myristoylamino group, and an arylcarbonylamino group such as an benzoylamino group); a ureido group (for example, an alkylureido group such as an N,N-dimethylaminoureido group, and an arylureido-group such as an N-phenylureido group and an N-(p-cyanophenyl)ureido group); a sulfonyl group (for example, an alkylsulfonyl group such as a methanesulfonyl group and a trifluoromethanesulfonyl group, and an arylsulfonyl group such as a p-toluenesulfonyl group); a sulfamoyl group (for example, an alkylsulfamoyl group such as a dimethylsulfamoyl group and a 4-(2,4-di-t-amylphenoxy)butylaminosulfonyl group, and an arylsulfamoyl group such as a phenylsulfamoyl group); an alkylthio group. (such as a methylthio group and a t-octylthio group); an arylthio group (such as a phenylthio group); and a heterocyclothio group (such as a 1-phenyltetrazole-5-thio group and 5-methyl-1,3,4-oxadiazole-2-tio group).

Examples of a cycloalkyl group and an alkenyl group are common to the above described substituent, and examples of an alkynyl group include a 1-propyne group, a 2-butyne group and a 1-hexyne group.

As the group represented by $R_{11}$ or $R_{12}$, a group having a non-aromatic ring structure such as a pyrrolidine ring, a piperidine ring and a morpholine ring is also preferable.

As $R_{13}$, an alkyl group, a cycdoalkyl group, an alkoxyl group and an acylamino group are preferred among the above substituents. n is an integer of 0 to 4, and plural groups represented by $R_{13}$ may be the same or different when n is 2 or more.

$R_{14}$ is an alkyl group such as a methyl group, an ethyl group, an i-propyl group, a t-butyl group, an n-dodecyl group and a 1-hexylnonyl group. $R_{14}$ is preferably a secondary or tertiary alkyl group, and examples of them include an isopropyl group, a sec-butyl group, a tert-butyl group and 3-heptyl group. The most preferable group represented by $R_{14}$ is an isopropyl group and a tert-butyl group. The alkyl group represented by $R_{14}$ may be substituted by a substituent composed of a carbon atom and a hydrogen atom and not substituted by any group containing another atom.

$R_{15}$ is an alkyl group such as an i-propyl group, a t-butyl group, an n-dodecyl group and a 1-hexylnonyl group. $R_{15}$ is preferably a secondary or tertiary alkyl group, and examples of them include an isopropyl group, a sec-butyl group, a tert-butyl group and a 3-heptyl group. The most preferable group represented by $R_{15}$ is an isopropyl group and a tert-butyl group. The alkyl group represented by $R_{15}$ may be substituted by a substituent composed of a carbon atom and a hydrogen atom and not substituted by any group containing another atom.

$R_{16}$ is an alkyl group such as an n-propyl group, an n-butyl group, an n-pentyl group, an n-hexyl group, an n-heptyl group, an isopropyl group, a sec-butyl group, a tert-butyl group and a 3-heptyl group. Specifically preferable substituent represented by $R_{16}$ is a straight chain alkyl group having 3 or more carbon atoms, and examples of that include an n-propyl group, an n-butyl group, n-pentyl group, n-hexyl group and an n-heptyl group, and an n-propyl group and an n-butyl group are most preferable. The alkyl group represented by $R_{16}$ may be substituted by a substituent composed of a carbon atom and a hydrogen atom and not substituted by any group containing another atom.

As the yellow chelate formable colorant, a compound represented by the following Formula (2) can be cited.

Formula (2)

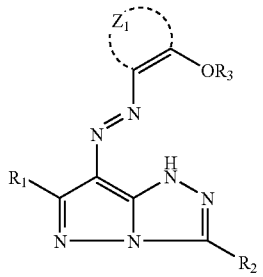

In Formula (2), the substituents represented by $R_1$ or $R_2$ are, for example, a halogen atom, an alkyl group or an alkyl group having 1 to 12 carbon atoms which may be substituted by a substituted bonding through an oxygen atom, a nitrogen atom, a sulfur atom or a carbonyl group, an aryl group, an alkenyl group, an alkynyl group, a hydroxyl group, an amino group, a nitro group, a carboxyl group, a cyano. group or a halogen atom. Examples of the substituent include a methyl group, an isopropyl group, a t-butyl group, a trifluoromethyl group, a methoxymethyl group, a 2-methanesulfonylethyl group, 2-methanesulfonylamide group, a cyclohexyl group, an aryl group such as a phenyl group, a 4-t-butylphenyl group, a 3-nitrophenyl group, a 3-acylaminophenyl group and a 1-methoxyphenyl group, a cyano group, an alkoxyl group, an aryloxy group, an acylamino group, an anilinoqgroup, a ureido group, a sulfamoyl group, an alkylthio group, an arylthio group, an alkoxycarbonylamino group, a sulfonamido group, a carbamoyl group, a sulfamoyl group, a sulfonyl group, an alkoxycarbonyl group, a heterocycloxy group, an acyloxy group, a carbamoyloxy group, a silyloxy group, an aryloxycarbonylamino group, an imido group, a heterocyclothio group, a sulfonyl group and an acyl group.

Alkyl groups and aryl groups represented by $R_3$ are common to the alkyl groups and aryl groups represented by $R_1$ or $R_2$.

Examples of the 5- or 6-member aromatic ring constituted together with the two carbon atoms represented by $Z_1$ include a ring of benzene, pyridine, pyrimidine, triazine, pyrazine, pyridazine, pyrrole, furan, thiophene, pyrazole, imidazole, triazole, oxazole and thiazole, these rings each may form a condensed ring with another aromatic ring. These rings may have a substituent thereon, and the examples of the substituent are common to those represented by $R_1$ or $R_2$.

As the magenta chelate formable colorant, a compound represented by the following Formula (3) can be cited.

Formula (3)

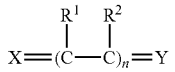

In the above Formula (3), X is a group or a group of atoms capable of forming a bidentate chelate, Y is a group of atoms necessary to form a 5- or 6-member aromatic hydrocarbon ring or a heterocyclic ring and $R^1$ and $R^2$ each represent a hydrogen atom, a halogen atom or a mono-valent substituent. n is 0, 1 or 2.

X is specifically preferably a group represented by the Following Formula (4).

Formula (4)

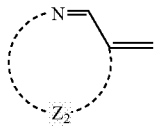

In the above Formula (4), $Z_2$ is a group of atoms necessary to form an aromatic nitrogen-containing heterocyclic ring substituted by a group which contains a nitrogen atom capable of forming at least one chelate. Concrete examples of the ring include a ring of pyridine, pyrimidine, thiazole and imidazole. These rings each may form a condensed ring together with a carbon ring such as a benzene ring or a heterocyclic ring such as a pyridine ring.

In the above Formula (3), Y is a group of atoms to form a 5- or 6-member aromatic hydrocarbon ring or a heterocyclic ring; these rings may have a substituted on the ring thereof and may have a condensed ring. Concrete examples of the ring include a 3H-pyrrole ring, an oxazole ring, an imidazole ring, a thiazole ring, a 3H-pyrrolidine ring, an oxazolidine ring, an imidazolidine ring, a thiazolidine ring, a 3H-indol ring, a benzoxazole ring, a benzimidazole ring, a benzothiazole ring, a quinoline ring and a pyridine ring. These rings each may form a condensed ring together with another carbon ring such as a benzene ring or a heterocyclic ring such as pyridine ring. Examples of a substituent of the ring include: an alkyl group, an aryl group, a heterocyclic group, an acyl group, an amino group, a nitro group, a cyano group, an acylamino group, an alkoxyl group, a hydroxyl group, an alkoxycarbonyl group and a halogen atom. These groups each may have further a substituent.

$R^1$ and $R^2$ each represent a hydrogen atom, a halogen atom such as a fluorine atom and a chlorine atom, or a mono-valent substituent. The mono-valent substituent is, for example, an alkyl group, an alkoxyl group, a cyano group, an alkoxycarbonyl group, an aryl group, a heterocyclic group, a carbamoyl group, a hydroxyl group, an acyl group and an acylamino group.

X represents a group or a group of atoms capable of forming at least one bidentate chelate, which may be one capable of forming a colorant of Formula (3), for example, 5-pyrazolone, imidazole, pyrazolopyrrole, pyrazolopyrazole, pyrazoloimidazole, pyrazotriazole, pyrazolotetrazole, barbituric acid, thiobarbituric acid, rhodanine, hydantoin, thiohydantoin, oxazolone, isooxazolone, indandione, pyrazolidinedione, hydroxypyridone and pyrazolipyridone are preferable.

(Binder Resin)

The ink layer of the invention contains a binder resin together with the foregoing colorant.

As the binder resin to be employed in the ink layer, a binder resin employed for a thermal transfer ink sheet to be used in a known thermal sublimation transfer method is applicable. For example, a water-soluble polymer such as a cellulose polymer, a polyacrylic acid polymer, a polyvinyl alcohol polymer and polyvinyl pyrrolidone, and an organic solvent-soluble polymer such as acryl resin, methacryl resin, polystyrene, polycarbonate, polysulfone, polyethersulfone, polyvinyl butyral, polyvinyl acetal, ethyl cellulose and nitro cellulose are employable. Among them, polyvinyl butyral, polyvinyl acetal and the cellulose resin are preferable, which are superior in the durability.

The contents of the colorant and the binder in the ink layer are not specifically limited; which are suitably decided from the viewpoint of the properties of the ink layer.

Various known additives can be added to the ink layer of the invention according to necessity additionally to the foregoing colorant and the binder. The ink layer can be formed, for example, by coating and drying an ink coating liquid by a known method such as a gravure coating method where the coating liquid is prepared by dissolving or dispersing the colorant, the binder and the additives in an optional solvent. The thickness of the ink layer of the invention is approximately from 0.1 to 3.0 μm, and preferably approximately from 0.3 to 1.5 μm.

(Protective Layer)

The thermal transfer ink sheet of the invention preferably has a thermally transferable protective layer. The thermally transferable protective layer is a transparent resin layer for forming a protective layer covering the surface of the image formed by thermal transfer onto the image receiving sheet.

The resin for forming the protective layer is, for example, a polyester resin, a polystyrene resin, an aryl resin, a polyurethane resin, an acrylurethane resin, a polycarbonate resin, an epoxy-modified resin of each the above resins, a mixture of each of the above resins, an ionizing radiation curable resin and a UV cutting resin. The polyester resin, polycarbonate resin, epoxy-modified resin and ionizing radiation curable resin are preferable. As the polyester resin, an alicyclic polyester resin derived from one or more kinds of diol component and acid component having an alicyclic compound. As the polycarbonate resin, an aromatic polycarbonate rein is preferable, and aromatic polycarbonates described in JP-A No. 11-151867 are specifically preferred.

Examples of the epoxy-modified resin to be employed in the invention include an epoxy-modified urethane, an epoxy-modified polyethylene, an epoxy-modified polyethylene terephthalate, an epoxy-modified polyphenyl sulfite, an epoxy-modified cellulose, an epoxy-modified polypropylene, an epoxy-modified polyvinyl chloride, an epoxy-modified polycarbonate, an epoxy-modified acryl, an epoxy-modified polystyrene, an-epoxy-modified polymethyl methacrylate, an epoxy-modified silicone, a copolymer of an epoxy-modified polystyrene and an epoxy-modified polymethyl methacrylate, a copolymer of an epoxy-modified acryl and an epoxy-modified polystyrene and a copolymer of an epoxy-modified acryl and an epoxy-modified silicone. The epoxy-modified acryl, the epoxy-modified polystyrene, the epoxy-modified polymethyl methacrylate and the epoxy-modified silicone are preferable and the copolymer of the epoxy-modified polystyrene and the epoxy-modified polymethyl methacrylate, the copolymer of the epoxy-modified acryl and the epoxy-modified polystyrene, and the copolymer of the epoxy-modified acryl and the epoxy-modified silicone are more preferable.

<Ionizing Radiation Curable Resin>

An ionizing radiation curable resin can be employed for the thermally transferable protective layer. An image excellent in the plasticizer resistivity and the anti-abrasion property can be obtained by using an ionizing radiation-curable resin in the thermally transferable protective layer. Known ionizing radiation curable resins can be employed. For example, applicable is a polymerized and crosslinked radical polymerizable polymer or oligomer, in which an photo polymerization initiator is added when necessary, by applying ionizing radiation such as electron beam or UV rays.

<UV Cutting Resin>

The principal purpose of the protective layer containing a UV cutting resin is to provide a light resistivity to the printed material. For the UV cutting resin, for example a resin obtained by reacting and bonding a reactive UV absorbent with the thermoplastic resin or the above ionizing radiation curable resin can be employed. In concrete, usable is a UV cutting resin obtained by introducing a reactive group having a addition polymerizable double bond (such as a vinyl group, an acryloyl group, a methacryloyl group, an alcoholic hydroxyl group, an amino group, a carboxyl group, an epoxy group or an isocyanate group) into a known non-reactive organic UV absorbent (UV absorbent containing, for example salicylate, benzophenone, benzotriazole, substituted acrylonitrile, a nickel chelate or a hindered amine).

The single structured thermal transferable protective layer described as above or a principal protective layer provided in a multi-layer structured thermal transferable protective layer is prepared so that the thickness is about 0.5 to 10 μm.

The thermal transferable protective layer of the invention is preferably provided on the substrate material through a non-transferable releasing layer.

The non-transferable releasing layer preferably contains (1) inorganic microparticles having an average particle diameter of not more than 40 nm in an amount of from 30 to 80% by weight together with a resin binder, (2) an alkyl vinyl ether-maleic anhydride copolymer, a derivative thereof or a mixture thereof in a rate of not less than 20% by weight, or (3) an ionomer in an ratio of not less than 20% by weight. The non-transferable releasing layer may contain another additive according to necessity.

For the inorganic microparticles, for example, a silica microparticles such as silica anhydride and colloidal silica, and a metal oxide such as tin oxide, zinc oxide and zinc antimonate can be employed. The particle diameter of the inorganic microparticle is preferably not more than 40 nm. When the diameter exceeds 40 nm, the irregularity of the surface of the thermal transferable protective layer is increased according to the irregularity of the releasing layer surface and undesirable lowering in the transparency of the protective layer is resulted.

For the resin binder to be mixed with the inorganic microparticles, any resin capable of mixing with the particle can be employed without any limitation. For example, polyvinyl alcohol resins (PVA) having various saponification degree, a polyvinyl acetal resin, a polyvinyl butyral resin, an acryl resin, a polyamide resin, a cellulose resin such as a cellulose acetate, an alkyl cellulose, a carboxymethyl cellulose, a hydroxyalkyl cellulose are employable.

The ratio of the inorganic microparticles to the other components mainly containing the resin binder (inorganic microparticles/other ingredients) is preferably from 30/70 to 80/20. When the ratio is less than 30/70, the effect of the microparticles become insufficient, and when the ratio exceeds 80/20, the releasing layer is not completely formed and a part where the substrate sheet and the protective layer are directly contacted is formed.

As the alkyl vinyl ether-maleic anhydride copolymer or the derivative thereof, one in which the alkyl group of the alkyl vinyl ether moiety is a methyl group or an ethyl group, or one in which the moiety of the maleic anhydride is. completely or partially made of a half ester with an alcohol such as methanol, ethanol, propanol, isopropanol, butanol and isobutanol, is employable.

Though the releasing layer may be formed only by the alkyl vinyl ether·maleic anhydride copolymer, the derivative thereof or the mixture thereof, another resin or microparticles may be further added for controlling the peeling force between the releasing layer and the protective layer. In such the case, the alkyl vinyl ether·maleic anhydride copolymer, the derivative thereof or the mixture thereof is preferably contained in the releasing layer in an amount of not less than 20% by weight. The effects of the alkyl vinyl ether·maleic anhydride copolymer or the derivative thereof becomes insufficient when the content is less than 20% by weight.

The resin or the microparticles to be added to the alkyl vinyl ether·maleic anhydride copolymer or the derivative thereof is not specifically limited as long as they can be mixed with the alkyl vinyl ether·maleic anhydride copolymer or the derivative thereof and give high transparency on the occasion of the layer formation. For example, foregoing inorganic particles and the resin binders capable of mixing with the inorganic particles can be preferably employed.

As the ionomer, Surlyn A, manufactured by du Pont Co., Ltd., and Chemipearl series, manufactured by Mitsui Chemicals, Inc., are employable. To the ionomer, for example, the foregoing inorganic particle, a resin binder capable of mixing with the inorganic particle, or another resin or microparticles can be added.

For forming the releasing layer, a coating liquid containing the compositions of one of the foregoing (1) to (3) in the designated ratio is prepared and coated on the substrate sheet by a known method such as a gravure coating method and a gravure reverse coating method and dried. The thickness of the non-transferable releasing layer is usually about 0.1 to 2 μm after dried.

The thermally transferable protective layer laminated on the substrate sheet through or not through the non-transferable releasing layer may have a plural layer structure or a single layer structure. When the layer is constituted of plural layers, an adhesion layer arranged on the outermost surface of the thermally transferable protective layer for increasing the adhesiveness of the thermally transferable protective layer to the image receiving layer surface of the printed material, an assistance protective layer and a layer for adding a function other than the essential function of the protective layer such as a forgery prevention layer and a hologram layer may be provided additionally to the principal protective layer for giving various durability to the image. Though the order of the principal protective layer and the other layers may be optionally decided, usually the other layers are arranged between the adhesion layer and the principal protective layer so that the principal protective layer is to be the outermost surface of the image receiving surface after the transfer.

An adhesion layer may be provided on the outermost surface of the thermally transferable protective layer. The adhesion layer can be formed by a resin having high heat adhering property such as an acryl resin, a vinyl chloride resin, a vinyl acetate resin, a vinyl chloride/vinyl acetate resin, a polyester resin and a polyamide resin. The above resin may be mixed with another material such as the foregoing ionizing radiation curable resin and UV cutting resin if necessity. The thickness of the adhesion layer is usually from 0.1 to 5 μm.

For providing the thermally transferable protective layer on the non-transferable releasing layer or the substrate sheet, for example, a protective layer coating liquid containing the protective layer forming resin, a adhesion layer coating liquid containing the heat adhesion resin and a coating liquid for forming the additional layer according to necessity are previously prepared and these liquids are coated and dried on the non-transferable releasing layer or the substrate sheet in the designated order. The coating can be carried out by a known method. A suitable primer layer may be provided between each layer.

<UV Absorbent>

At least one of the layer in the thermally transferable protective layer preferably contains a UV absorbent. The UV absorbent is specifically preferably contained in the heat adhesion layer since the effects of the UV absorbent are lowered during a prolonged period when the UV absorbent is added into the transparent resin layer because the transparent resin layer is placed on the outermost surface after the transfer of the protective layer.

A UV absorbent containing salicylic acid, benzophenone, benzotriazole or cyanocarylate can be employed. Concrete examples of the UV absorbent employable in the invention include Tinuvin 234, Tinuvin 320, Tinuvin 326, Tinuvin 327, Tinuvin 328, Tinuvin 312 and Tinuvin 315, each manufactured by Ciba-Geigy Co., Ltd., Sumisorb-110, Sumisorb-130, Sumisorb-140, Sumisorb-200, Sumisorb-300, Sumisorb-320, Sumisorb-340, Sumisorb-350 and Sumisorb-400, each manufactured by Sumitomo Kagaku Kogyo Co., Ltd., and Mark LA-32, Mark LA-36 and Mark 1413, each manufactured by Adeca-Argus Co., Ltd., which are available on the market.

A random copolymer having a Tg of not less than 60° C., and preferably not less than 80° C., formed by random copolymerization of a reactive UV absorbent and an acryl monomer can be also employed.

As the above reactive UV absorbent, ones can be employed which are formed by introducing a group having additional polymerizable double bond such as a vinyl group, an acryloyl group and a methacryloyl group, an alcoholic hydroxide group, an amino group, a carboxyl group, an epoxy group or an isocyanate group to a known non-reactive UV absorbent containing, for example salicylate, benzophenone, benzotriazole, substituted acrylonitrile, a nickel chelate and a hindered amine. In concrete, they are available on the market under the commercial name of UV635 and UVA633L, each manufactured by BASF Japan Ltd., and PUVA-30M, manufactured by Otsuks Chemical Co., Ltd., and employable in the invention.

The amount of the reactive UV absorbent in the random copolymer of the reactive UV absorbent and the acryl monomer is from 10 to 90% by weight, and preferably from 30 to 70% by weight. The molecular weight of the random copolymer is approximately from 5,000 to 250,000, and preferably approximately from 9,000 to 30,000. The UV absorbent and the random copolymer of the reactive UV absorbent and the acryl type monomer may be contained alone or in combination thereof. The adding amount of the random copolymer of the reactive UV absorbent and the acryl type monomer is preferably from 5 to 50% by weight based on weight of the layer containing those.

Of course, a light fastness improving agent other than the UV absorbent may be contained. The light fastness improving agent is an agent for preventing the modification and the decomposition of the colorant by blocking the action of light energy, heat energy and oxidation. In concrete, a light stabilizer known as the additive for synthesized resin is employable other than the above-mentioned UV cutting agent. In such the case, the UV absorbent is contained in at least one layer in the thermal transferable protective layer, namely in at least one of the releasing layer, transparent resin layer and the thermal adhesion layer, and is specifically preferably contained in the thermal adhesion layer.

Though the using amount of the light fastness improving agent including the UV absorbent is not specifically limited, it is preferably from 0.05 to 10 parts by weight, and more preferably from 3 to 10 parts by weight in 100 parts by weight of the resin constituting the layer in which the light fastness improving agent is contained. The effects of the light fastness improving agent are hardly obtained when the using amount is too small, and the use of excessive amount is uneconomical.

Other than the light fastness improving agent, various kinds of additive such as a fluorescent whitening agent and a filler may be added to the adhesion layer in a suitable amount.

The transparent resin layer of the protective layer transfer sheet may be provided singly or in series with the surface of the thermal transfer ink sheet.

(Thermal Resistive Sliding Layer)

In the thermal transfer ink sheet of the invention, it is preferable to provide a thermal resistive sliding layer on the surface of the substrate sheet reverse to the ink layer side surface.

The thermal resistive sliding layer is provided for preventing the thermal fusion of the substrate sheet with the heating device such as a thermal head so as to smoothly slide the sheet and for removing the adhered matter on the thermal head.

For the thermal resistive sliding layer, a natural or a synthesized resin, for example, a cellulose resin such as ethyl cellulose, hydroxyl cellulose, methyl cellulose, cellulose acetate, cellulose acetate butylate and cellulose nitrate; a vinyl resin such as polyvinyl alcohol, polyvinyl acetate, polyvinyl butyral, polyvinyl acetal and polyvinyl pyrrolidone; an acryl resin such as polymethyl methacrylate, polyethyl methacrylate, polyacrylamide and acrylonitrilestyrene copolymer; polyimide resin, polyamide resin, polyamideimide resin, polyvinyltoluene resin, chromanindene resin, a polyester resin, polyurethane resin, silicone-modified or fluorine-modified urethane resin; are employed alone or in a form of mixture. For further raising the heat. resistivity of the thermal resistive sliding layer, it is preferable to use a crosslinked resin layer formed by using a hydroxyl group-containing resin having a reactive group, together with a cross linking agent such as polyisocyanate.

A liquid or solid form release agent or a lubricant may be added to the thermal resistive sliding layer for giving a lubricative property against the thermal head. As the release agent or the lubricant, various kind of wax such as polyethylene wax and paraffin wax, a higher aliphatic alcohol, an organopolycyloxane, an anionic surfactant, a cationic surfactant, an amphoteric surfactant, a nonionic surfactant, a fluorinated surfactant, a metal soap, an organic carboxylic acid and its derivative, a fluororesin, a silicone resin, and inorganic microparticles such as talc and silica are employable. The amount of the lubricant contained in the heat resistive lubricant layer is from 5 to 50%, and preferably about from 10 to 30%, by weight. The thickness of the heat resistive lubricative layer is about from 0.1 to 10 μm, and preferably about from 0.3 to 5 μm.

EXAMPLES

The invention will be specifically described below referring examples, but the invention is not limited thereto.

Example 1

<Preparation of Thermal Transfer Image Receiving Sheet>

Preparation of Thermal Transfer Image Receiving Sheet 1: Comparative Example An intermediate layer coating liquid 1 and an image receiving layer coating liquid 1 of the following compositions were applied on one side of a foamed film (pyrene film P4256 by Toyobo Co., Ltd. with a thickness of 60 μm) by a gravure printing machine so that the solid contents of these coating liquids applied were 0.2 g/m$^2$ and 5.0 g/m$^2$, respectively, in terms of dry weight.

| (Intermediate layer coating liquid 1) | |
|---|---|
| Urethane resin (DP urethane by Showa Ink Kogyo Co., Ltd.): | 60 parts by weight |
| Hardening agent (Coronate 2030 by Nihon Polyurethane Kogyo Co., Ltd.): | 1 part by weight |
| Methyl ethyl ketone/toluene = 1/1: | 20 parts by weight |
| **(Image receiving layer coating liquid 1)** | |
| Vinyl chloride - vinyl acetate copolymer (Denka vinyl #1000A by Denkikagaku Koyo Co., Ltd.): | 60 parts by weight |
| Polyester (Byron 600 by Toyobo Co., Ltd.): | 40 parts by weight |
| Amino modified silicone (X-22-3050C by Shinetsu Chemical Co. Ltd.): | 2 parts by weight |
| Epoxy modified silicone (X-22-3000E by Shinetsu Chemical Co. Ltd.): | 2 parts by weight |
| Methyl ethyl ketone/toluene = 1/1: | 50 parts by weight |

The back surface layer coating liquid 1 having the following composition was applied on one of the coated sheet (New-Top by Shin-Oji Paper Co., Ltd.: 157 g/m$^2$) by a gravure printing machine so that the solid content of the coating liquid applied was 5.0 g/m$^2$ in terms of dry weight. The back surface layer was formed in this manner.

| (Back surface layer coating liquid 1) | |
|---|---|
| Acryl resin (BR-85 by Mitsubishi Rayon Co., Ltd.): | 10 parts by weight |
| Teflon (polytetrafluoroethylene, trademark registered) filler (Levron L-5 by Daikin Industries Ltd.): | 0.1 part by weight |
| Methyl ethyl ketone/toluene = 1/1: | 89.5 parts by weight |

Then an adhesive layer coating liquid 1 of the following composition was applied on the other side of the aforementioned coated sheet by a gravure printing machine and was dried so that the solid of the coating liquid applied was 5.0 g/m$^2$ in terms of dry weight. The adhesive layer was formed in this manner.

| (Adhesive layer coating liquid 1) | |
|---|---|
| Polyester based adhesive (SK Dyne 5273 by Soken Kagaku Co., Ltd.): | 80 parts by weight |
| Methyl ethyl ketone/toluene/ethyl acetate = 1/1/1: | 20 parts by weight |
| polyethylene filler (average diameter: 5 μm): | 80 parts by weight |

The surface coated with adhesive of the aforementioned coated sheet was placed on the surface of the foamed film not formed with an image receiving layer and then adheared each other by dry lamination. Lamination was conducted at a temperature of 60° C. with pressure applied for 20 seconds. The thermal transfer image receiving sheet 1 was prepared in this manner.

Preparation of Thermal Transfer Image Receiving Sheet 2: Comparative Example An aqueous thermal insulation layer coating liquid 1 of the following composition was applied on the polyolefin laminate sheet (described as "RC sheet" in Table 1), and was dried. Then thermal transfer image receiving sheet 2 was formed followed by drying. In the process of coating, the solid contents of the thermal insulation layer and the image receiving layer were adjusted to 25 g/m$^2$, and 4.0 g/m$^2$, respectively.

| (Thermal insulation layer coating liquid 1) | |
|---|---|
| Hollow grain microsphere MB927 (by Hohnen Inc.; average diameter: 7 μm): | 50 parts by weight |
| Urethane emulsion: | 45 parts by weight |
| Methyl cellulose: | 5 parts by weight |
| (Image receiving layer coating liquid 2) | |
| Polyester resin emulsion (Byronal MD-1200 by Toyobo Co., Ltd.): | 65 parts by weight |
| Silica microparticles (Aerosil 200 by Nihon Aerosil Co., Ltd.): | 25 parts by weight |
| Long-chain alkyl group release agent PR-18W (by Nihon Shokubai Co., Ltd.): | 5 parts by weight |
| Associated thickener (BORCHIGEL-L75 by Hoechst Japan): | 5 parts by weight |

Preparation of Thermal Transfer Image Receiving Sheet 3: Comparative Example

The thermal insulation layer coating liquid 2 containing the following foamed grains was applied on a 188-μm thick polyethylene terephthalate film (abbreviated as PET in Table 1; trade name: Lumilar S10 by Toray Industries, Inc.) using a wire bar. Then a 10-μm thick thermal insulation layer was obtained after drying with a dryer.

| (Thermal insulation layer coating liquid 2) | |
|---|---|
| Foamed grain (Matsumoto Microsphere F-80GSE; grain diameter: 20 through 30 μm; by Matsumoto Yushi Co., Ltd.): | 10 parts by weight |
| Kuraray Poval PVA203 (polyvinyl alcohol; degree of polymerization: 300; by Kuraray Co., Ltd.): | 10 parts by weight |
| Purified Water: | 80 parts by weight |

Image receiving layer coating liquid 3 of the following composition is applied on the thermal insulation layer formed according to the aforementioned procedure, using a wire bar. An image receiving layer was produced by drying at a drying temperature of.80° C. for one minute. After that, releasing layer coating liquid 1 of the following composition was coated using the wire bar. A releasing layer was produced by drying at a drying temperature of 80° C. for one minute. Thus prepared thermal transfer image receiving sheet 3 was subjected to a aging treatment at 60° C. for 12 hours.

| (Image receiving layer coating liquid 3) | |
|---|---|
| Polyvinyl acetal resin (KS-1 by Sekisui Chemical Co., Ltd.): | 4.7 parts by weight |
| Toluene: | 21.4 parts by weight |
| Methyl ethyl ketone: | 64.3 parts by weight |
| (Releasing layer coating liquid 1) | |
| Silicone resin (SR2411 by Toray Silicone Co., Ltd.): | 16.65 parts by weight |
| Acryl silicone block copolymer (LDL500 by Natoko Co., Ltd.): | 0.37 parts by weight |
| 2-propanol: | 85.5 parts by weight |

[Preparation of Thermal Transfer Image Receiving Sheet 4: the Present Invention]

A polyethylene coated sheet was used as a substrate (this polyethylene coated sheet is described as "RC sheet" in Table 1): wherein both surfaces of the base paper having a weight of 170 g/m$^2$ were covered with polyethylene; 8 percent anatase type titanium oxide was contained in the polyethylene on the porous layer side surface; 0.05 g/m$^2$ of gelatin undercoated layer was provided on the surface of the porous layer; and a back layer containing latex-based polymer of 0.2 g/m$^2$ having the Tg of about 80° C. was provided on the surface opposite to the porous layer. Thermal insulation layer coating liquid 3 of the following composition was applied on the porous layer side surface using a wire bar so as to have a solid content of 3.5.g/m$^2$, and then dried at 120° C. for one minute. Subsequently, intermediate layer coating liquid 2 of the following composition was applied using a wire bar coating method, and an intermediate layer having a solid dry weight of 2.0 g/m$^2$ was formed by drying at 120° C. for one minute. Then image receiving layer coating liquid 4 of the following composition was applied by a wire bar coating method and dried at 120° C. for one minute to form a image receiving layer having a solid content of 4.0 g/m$^2$. Thermal transfer image receiving sheet 4 was prepared in this manner.

| (Thermal insulation layer coating liquid 3) | |
|---|---|
| 5% aqueous solution of polyvinyl alcohol (PVA235 by Kuraray Kogyo Co., Ltd.): | 30 parts by weight |
| Chemical vapor deposition method silica particles(Aerosil 200 by Nihon Aerosil Co., Ltd.; primary grain diameter: 12 nm): | 20 parts by weight |
| Purified water: | 20 parts by weight |
| This thermal insulation layer coating liquid 3 had a viscosity of 40 mPa · s at 40° C. | |
| (Intermediate layer coating liquid 2) | |
| 8% aqueous solution of polyvinyl alcohol (PVA235 by Kuraray Kogyo Co., Ltd.): | 15 parts by weight |
| Gelatin: | 15 parts by weight |
| 6% aqueous solution of nitric acid: | 6 parts by weight |
| Anatase type titanium oxide: | 10 parts by weight |
| Pure water: | 54 parts by weight |
| This intermediate layer coating solution 2 had a viscosity of 60 mPa · s at 40° C. | |
| (Image receiving layer coating liquid 4) | |
| Water-dispersed polyester (MD-1200 by Toyobo Co., Ltd.; solid content: 34 wt %): | 50 parts by weight |
| Gelatin: | 8 parts by weight |
| Fluorine-containing surfactant (FC-4430 by Sumitomo 3M Ltd.): | 1.2 parts by weight |
| Pure water: | 31.2 parts by weight> |
| This image receiving layer coating liquid 4 had a viscosity of 60 mPa · s at 40° C. | |

[Preparation of Thermal Transfer Image Receiving Sheet 5: the Present Invention]

The thermal transfer image receiving sheet 5 was prepared in the same procedure as the aforementioned thermal transfer image receiving sheet 4, except that thermal insulation layer coating liquid 4 of the following composition was used instead of thermal insulation layer coating liquid 3 used in the production of the aforementioned thermal transfer image receiving sheet 4.

| (Thermal insulation layer coating liquid 4) | |
|---|---|
| Hollow particles (Nipol MH5055 by Nippon Zeon Co., Ltd.; average RN diameter: 0.5 μm; porosity: 55%): | 31.2 parts by weight |

-continued

| (Thermal insulation layer coating liquid 4) | |
|---|---|
| 8% aqueous liquid of polyvinyl alcohol (PVA235 by Kuraray Kogyo Co., Ltd.): | 31.2 parts by weight |
| Gelatin: | 6.4 parts by weight |
| Purified water: | 31.2 parts by weight |

Thermal insulation layer coating liquid 4 had a viscosity of 40 mPa · s at 40° C.

[Preparation of Thermal Transfer Image Receiving Sheet 6: the Present Invention]

The thermal transfer image receiving sheet 6 was prepared in the same procedure as the aforementioned thermal transfer image receiving sheet 4, except that the thermal insulation layer coating liquid 3, intermediate layer coating liquid 3 and image receiving layer coating liquid 4 were applied by a three layers simultaneously coating method using a slide hopper type multilayer coating apparatus and dried by hot air immediately thereafter.

[Preparation of Thermal Transfer Image Receiving Sheet 7: the Present Invention]

The thermal transfer image receiving sheet 7 was prepared in the same procedure as the aforementioned thermal transfer image receiving sheet 6, except that the above three layers were coated simultaneously, and were then treated in a one-minute setting process by blowing cold air having a temperature of 5° C., which was followed by the process of drying by hot air.

[Preparation of Thermal Transfer Image Receiving Sheet 8: the Present Invention]

The thermal transfer image receiving sheet 8 was prepared in the same procedure as the aforementioned thermal transfer image receiving sheet 7, except that aging was carried out at a temperature of 45° C. for 24 hours after one-day drying operation.

[Preparation of Thermal Transfer Image Receiving Sheet 9: the Present Invention]

The thermal transfer image receiving sheet 9 was prepared in the same procedure as the aforementioned thermal transfer image receiving sheet 8, except that an image receiving layer coating liquid 5 was used, wherein this image receiving layer coating liquid 5 was prepared by adding 3.5 parts by weight of $NiCl_2$ as a metal source to the image receiving layer coating liquid 4.

[Preparation of Thermal Transfer Image Receiving Sheet 10: the Present Invention]

The thermal transfer image receiving sheet 10 was prepared in the same procedure as the aforementioned thermal transfer image receiving sheet 9, except that the image receiving layer coating liquid 4 was replaced by the image receiving layer coating liquid 6 of the following composition, and a releasing layer having a solid content of 0.5 g/m$^2$ was formed on the image receiving layer using the releasing layer coating liquid 2 of the following composition, in such a way that the four layers including the releasing layer were simultaneously coated.

| (Image receiving layer coating liquid 6) | |
|---|---|
| Water-dispersed polyester (MD-1200 by Toyobo Co., Ltd.; solid content: 34 wt %): | 50 parts by weight |

-continued

| | |
|---|---|
| Gelatin: | 8 parts by weight |
| $NiCl_2$: | 3.5 parts by weight |
| Purified water: | 40.8 parts by weight |

Image receiving layer coating liquid 6 had a viscosity of 60 mPa · s at 40° C.

| (Releasing layer coating liquid 2) | |
|---|---|
| Water-dispersed polyester (MD-1200 by Toyobo Co., Ltd.; solid fraction: 34 wt %): | 50 parts by weight |
| Gelatin: | 8 parts by weight |
| Fluorine-containing surfactant (FC-4430 by Sumitomo 3M Ltd.): | 1.2 parts by weight |
| Purified water: | 40.8 parts by weight |

This releasing layer coating liquid 2 had a viscosity of 60 mPa · s at 40° C.

[Preparation of Thermal Transfer Image Receiving Sheet 11: the Present Invention]

The thermal transfer image receiving sheet 11 was prepared in the same procedure as the aforementioned thermal transfer image receiving sheet 10, except that the polyethylene coated sheet used in the substrate sheet was replaced by a 100 μm thick polyethylene terephthalate film (abbreviated as PET in Table 1) provided with the undercoating layer described in the Example 1 of JP-A No. 2003-72229.

[Preparation of Thermal Transfer Image Receiving Sheet 12: the Present Invention]

The thermal transfer image receiving sheet 12 was prepared in the same procedure as the aforementioned thermal transfer image receiving sheet 10, except that the thermal insulation layer coating liquid 3 was replaced by the thermal insulation layer coating liquid 4 used to produce the thermal transfer image receiving sheet 5.

[Preparation of Thermal Transfer Image Receiving Sheet 13: the Present Invention]

The thermal transfer image receiving sheet 13 was prepared according to the following procedure: In the production of aforementioned thermal transfer image receiving sheet 10, the thermal insulation layer coating liquid 3 and intermediate layer coating liquid 2 were used to simultaneously coat the thermal insulation layer and the intermediate layer using a slide hopper type multilayer coating apparatus. These layers were then treated in a one-minute setting process by blowing cold air having a temperature of 5° C., which was followed by the process of drying by hot air. After that, the image receiving layer coating liquid 6 and releasing layer coating liquid 2 were used to simultaneously coat the image receiving layer and the releasing layer using a slide hopper type multilayer coating apparatus. These layers were then treated in a one-minute setting process by cold air having a temperature of 5° C., which was followed by the process of drying by hot air. Then aging was carried out at a temperature of 45° C. for 24 hours after an one-day drying operation.

[Preparation of Thermal Transfer Image Receiving Sheet 14: the Present Invention]

The thermal transfer image receiving sheet 14 was prepared in the same procedure as the aforementioned thermal transfer image receiving sheet 10, except that the amount of purified water in the thermal insulation layer coating liquid 3 was reduced so as to change the viscosity of the liquid from 40 mPa·s to 70 mPa·s at 40° C. to prepare thermal insulation layer coating liquid 5.

[Preparation of Thermal Transfer Image Receiving Sheet 15: the Present Invention]

The thermal transfer image receiving sheet 15 was prepared in the same procedure as the aforementioned thermal transfer image receiving sheet 13, except that the thermal insulation layer coating liquid 6 and image receiving layer coating liquid 7 prepared by adding a surfactant to the thermal insulation layer coating liquid 3 and image receiving layer coating liquid 6 under the following conditions are utilized, and further mold releasing layer coating liquid 3 of the following composition was used instead of releasing layer coating liquid 2.

(Addition of Surfactant)

The thermal insulation layer coating liquid 5 was prepared by adding 0.3 parts by weight fluorine-containing surfactant to the thermal insulation layer coating liquid 3. Further, the image receiving layer coating liquid 7 was prepared by adding 0.85 parts by weight fluorine-containing surfactant to the image receiving layer coating liquid 6.

| (Releasing layer coating liquid 3) | |
|---|---|
| Water-dispersed polyester (MD-1200 by Toyobo Co., Ltd.; solid fraction: 34 wt %): | 50 parts by weight |
| Gelatin: | 8 parts by weight |
| Silicone emulsion (X-52-175 by Shinetsu Chemical Co. Ltd.): | 1.2 parts by weight |
| Purified water: | 40.8 parts by weight |

The releasing layer coating liquid 3 had a viscosity of 60 mPa · s at 40° C.

(Balance of Surface Tension Between Coating Liquids)

The following describes the results of measuring the differences in static surface tension and dynamic surface tension between the aforementioned coating liquids, using a commercially available measuring apparatus.

(Balance of Static Surface Tension)

Intermediate layer coating liquid 2—thermal insulation layer coating liquid 6=3 mN/m , Image receiving layer coating liquid 7—releasing layer coating liquid 3=2 mN/m (Balance of Dynamic Surface Tension)

Intermediate layer coating liquid 2—thermal insulation layer coating liquid 6=9 mN/m Image receiving layer coating liquid 7—mold releasing layer coating liquid 3=6 mN/m

[Preparation of Thermal Transfer Image Receiving Sheet 16: the Present Invention]

The releasing layer coating liquid 4 of the following composition was applied on the thermal transfer image receiving sheet 9 using a wire bar, so that the solid content was 0.5 g/m$^2$, and thermal transfer image receiving sheet 16 was prepared by drying thereafter.

| (Releasing layer coating liquid 4) | |
|---|---|
| Vinyl chloride - vinyl acetate copolymer (vinyl chloride acetate/vinyl acetate = 95/5): | 10 parts by weight |
| Epoxy modified silicone (X-22-8300T by Shinetsu Chemical Co. Ltd.): | 1 part by weight |
| Methyl ethyl ketone/toluene = 1/1: | 40 parts by weight |

In Table 1, the typical conconstitution and features of the manufacturing method for the thermal transfer image receiving sheets 1 through 16 prepared according to the aforementioned procedure were summarized <<Image Formation>>

Each of the above prepared thermal transfer image receiving sheets was placed on the following thermal transfer ink sheet and set into a thermal transfer recording apparatus having a thermal line head with a square-shaped resistor (length in the main scanning direction of 80 μm×length in the sub-scanning direction of 120 μm) and 300 dpi (dpi: number of dot per 2.54 cm), and conveyed while contacting by pressing with the thermal head and a platen roller. Step pattern patches of yellow, magenta, cyan and neutral (by overlapping yellow, magenta and cyan) were formed by transferring the colorants onto the image receiving layer of the thermal transfer image receiving sheet by heating from the back side of the ink layer while successively increasing the applying energy at a conveying rate of 2.5 msec/line and a conveying length per line of 85 μm. Thus Images 1 through 16 were prepared.

Thermal transfer sheet A: A thermal transfer ink sheet for Camedia P-400, manufactured by Olympus Co., Ltd., which was employed in combination with Thermal Transfer Image Receiving Sheets 1 to 8.

Thermal transfer sheet B: A thermal transfer ink sheet for Pe 602, manufactured by Konica Minolta Photo Imaging Inc., which was employed in combination with Thermal Transfer Image Receiving Sheets 9 to 16.

<<Evaluation of Formed Image>>

The above printed images were subjected to the following evaluation methods.

(Evaluation of Curling Property)

The above prepared thermal transfer image receiving sheet was cut into a square of 20 cm×20 cm, and placed on a flat plate so that the image receiving layer is to be up side and stood for 5 hours under a condition of 23° C. and 50% RH. And then the height of each of the four corners from the flat plate was measured and the largest value was defined as the measure of curling property.

(Evaluation of Printing Sensitivity)

In the above-mentioned image forming method, the image formation was performed employing each of the thermal transfer image receiving sheet while varying the applying energy and the applying energy E (mi/mm$^2$) necessary for forming a reflective density of 1.0 was measured and the printing sensitivity was evaluated according to the following criteria.

A: E<4.8 mJ/mm$^2$

B: 4.8 mJ/mm$^2$<E<5.2 mJ/mm$^2$

C: 5.2 mJ/mm$^2$<E<5.6 mJ/mm$^2$

D E>5.6 mJ/mm$^2$ (Evaluation on Anti-White Spots in the Image)

Occurrence of the white spots in the image (white spots in a solid image) in the step pattern patch image was visually observed and the anti-white spots property was evaluated according to the following criteria.

A: No occurrence of the white spots in the image was observed.

B: Almost no occurrence of the white spots in the image was observed.

C: Occurrence of minute white spots was sporadically observed in the image but acceptable for practical use.

D: Occurrence of white spots was strongly observed in the image and the image quality was not acceptable for practical use.

(Evaluation of Adhesion Between Layers)

Each of the thermal transfer image receiving sheets was subjected to a cross cut test according to JIS K5400. Using a single-edged razor blade, eleven 90-degree cuts were placed into the surface of each thermal transfer image receiving sheet at an interval of 1 mm in both the longitudinal and lateral directions, so that a total of a hundred 1-mm squares were prepared. A commercially available Cellophane tape was placed on these squares. The sheet was separated in the perpendicular direction by holding one end with hand. The following criteria was used to evaluate the percentage of the area of the separated thermal transfer image receiving sheet constituent layer based the area of the attached:

A: No separation of the thermal transfer image receiving sheet

B: The percentage of the area of the separated thermal transfer image receiving sheet constituent layer was less than 5%.

C: The percentage of the area of the separated thermal transfer image receiving sheet constituent layer was 5 or more but less than 10%.

D: The percentage of the area of the separated thermal transfer image receiving sheet constituent layer was 10 or more but less than 20%.

E: The percentage of the area of the separated thermal transfer image receiving sheet constituent layer was 20% or more.

(Evaluation of Durability of Image)

After the maximum density Dmax of the neutral (superimposed yellow, magenta and cyan) image has been measured, this image was left to stand for 170 hours at a temperature of 50° C. with a relative humidity of 80%. The maximum density Dmax2 of the neutral image was then measured in the similar manner and the image residual ratio was calculated according to the following formula. The image keeping quality (moisture resistance) was evaluated according to the following criteria.

$$\text{Image residual rate (\%)}=(D\text{max2}/D\text{max1})\times 100$$

A: The image residual rate is 97% or more.

B: The image residual rate is 90 or more but less than 97%.

C: The image residual rate is 80 or more not less than 90%.

D: The image residual rate is less than 80%.

Table 1 shows the results of the above evaluations:

As is clear from the results given in Table 1, the thermal transfer image receiving sheet having the composition disclosed in the present invention is superior in preventing curling, preventing white spots in the image, printing sensitivity, adhesion between the layers, and durability of the image (moisture resistance), when compared with the comparative examples.

What is claimed is:

1. A method for producing a thermal transfer image receiving sheet comprising the steps of:

(i) providing a thermal insulation layer on a substrate by an aqueous coating method;

(ii) providing an intermediate layer on the thermal insulation layer by the aqueous coating method;

(iii) providing an image receiving layer on the intermediate layer by the aqueous coating method; and (iv) drying the coated thermal insulation layer, the coated intermediate layer and the coated image receiving layer, wherein the thermal insulation layer, the image receiving layer and the intermediate layer each contain a hydrophilic binder.

2. The method for producing a thermal transfer image receiving sheet of claim 1 further comprising a step of providing an additional layer by the aqueous coating method prior to the step (iv).

3. The method for producing the thermal transfer image receiving sheet of claim 1, wherein a pair of adjacent layers are formed by a simultaneous multilayer coating method.

4. The method for producing the thermal transfer image receiving sheet of claim 1, wherein all layers provided on a surface of the substrate having the image receiving layer are formed by a simultaneous multilayer coating method.

5. The method for producing the thermal transfer image receiving sheet of claim 1 further comprising a step of setting by cooling the coated thermal insulation layer, the coated

TABLE 1

| Thermal transfer image receiving sheet | Main composition | | | | | Production conditions | | | Results of Evaluation | | | | | |
|---|---|---|---|---|---|---|---|---|---|---|---|---|---|---|
| No. | Substrate | *1 | *2 | *3 | *4 | Number of coatings | Setting process (provided or not) | Aging process (provided or not) | Curling tendency | Sensitivity | Anti-white spots property | Adhesion between layers | Durability of Image | Remarks |
| 1 | Foamed film | — | 1 | 1 | — | 2 | Not | Not | D | B | B | C | C | Comp. |
| 2 | RC sheet | 1 | — | 2 | — | 2 | Not | Not | B | D | D | D | D | Comp. |
| 3 | PET | 2 | — | 3 | 1 | 3 | Not | Not | B | C | C | E | D | Comp. |
| 4 | RC sheet | 3 | 2 | 4 | — | 3 | Not | Not | B | C | C | C | B | Inv. |
| 5 | RC sheet | 4 | 2 | 4 | — | 3 | Not | Not | B | B | C | C | B | Inv. |
| 6 | RC sheet | 3 | 2 | 4 | — | 1 | Not | Not | B | C | B | C | B | Inv. |
| 7 | RC sheet | 3 | 2 | 4 | — | 1 | Provided | Not | B | C | A | C | B | Inv. |
| 8 | RC sheet | 3 | 2 | 4 | — | 1 | Provided | Provided | B | C | A | B | B | Inv. |
| 9 | RC sheet | 3 | 2 | 5 | — | 1 | Provided | Provided | B | B | A | B | A | Inv. |
| 10 | RC sheet | 3 | 2 | 6 | 2 | 1 | Provided | Provided | B | B | A | A | A | Inv. |
| 11 | PET | 3 | 2 | 6 | 2 | 1 | Provided | Provided | B | B | A | A | A | Inv. |
| 12 | RC sheet | 4 | 2 | 6 | 2 | 1 | Provided | Provided | B | A | A | A | A | Inv. |
| 13 | RC sheet | 3 | 2 | 6 | 2 | 2 | Provided | Provided | B | B | A | B | A | Inv. |
| 14 | RC sheet | 5 | 2 | 6 | 2 | 1 | Provided | Provided | B | B | C | A | A | Inv. |
| 15 | RC sheet | 6 | 2 | 7 | 3 | 2 | Provided | Provided | B | B | C | B | A | Inv. |
| 16 | RC sheet | 3 | 2 | 6 | 4 | 2 | Provided | Provided | B | A | A | A | A | Inv. |

*1: Thermal insulation layer No.
*2: Intermediate layer No.
*3: Image receiving layer No.
*4: Releasing layer No.
Comp.: Comparative example
Inv.: Present invention intermediate layer and the coated image receiving layer between the step of providing the image receiving layer and the step of drying the coated layers.

6. The method for producing the thermal transfer image receiving sheet of claim 1 further comprising a step of aging the coated thermal insulation layer, the coated intermediate layer and the coated image receiving layer after the step of drying the coated layers.

7. The method for producing the thermal transfer image receiving sheet of claim 1 comprising a step of simultaneously coating two or more layers, wherein the following relationship is satisfied:

$$\eta_2 > \eta_1$$

wherein $\eta_1$ represents a viscosity of a coating liquid of an undermost layer and $\eta_2$ represents a viscosity of a coating liquid of any one of other layers.

8. The method for producing the thermal transfer image receiving sheet of claim 1 comprising a step of simultaneously coating two or more layers, wherein Formulas (1) and (2) are satisfied in every adjacent pair of layers:

$$Ts(L) \geqq Ts(U) \quad \text{Formula (1)}$$

$$Td(L) \geqq Td(U) \quad \text{Formula (2)}$$

wherein:

Ts(L) represents a static surface tension of a coating liquid of a lower layer of the adjacent pair of layers;

Ts(U) represents a static surface tension of a coating liquid of an upper layer of the adjacent pair of layers;

Td(L) represents a dynamic surface tension of the coating liquid of the lower layer of the adjacent pair of layers; and Td(U) represents a dynamic surface tension of the coating liquid of the upper layer of the adjacent pair of layers.

* * * * *